US010653938B1

(12) United States Patent
Traustason

(10) Patent No.: US 10,653,938 B1
(45) Date of Patent: May 19, 2020

(54) METHOD AND APPARATUS FOR A USER-CONFIGURABLE ATHLETIC TRAINING APPARATUS

(71) Applicant: Gudmundur Traustason, Deerfield Beach, FL (US)

(72) Inventor: Gudmundur Traustason, Deerfield Beach, FL (US)

( * ) Notice: Subject to any disclaimer, the term of this patent is extended or adjusted under 35 U.S.C. 154(b) by 53 days.

(21) Appl. No.: 15/693,644

(22) Filed: Sep. 1, 2017

Related U.S. Application Data

(63) Continuation-in-part of application No. 14/829,407, filed on Aug. 18, 2015, now Pat. No. 9,987,541.

(60) Provisional application No. 62/038,433, filed on Aug. 18, 2014.

(51) Int. Cl.
*A63B 71/06* (2006.01)
*A63B 69/00* (2006.01)
*A63B 24/00* (2006.01)

(52) U.S. Cl.
CPC ..... *A63B 71/0622* (2013.01); *A63B 24/0075* (2013.01); *A63B 69/002* (2013.01); *A63B 69/0053* (2013.01); *A63B 69/0097* (2013.01); *A63B 2071/0658* (2013.01); *A63B 2207/02* (2013.01); *A63B 2220/56* (2013.01); *A63B 2225/54* (2013.01); *A63B 2243/007* (2013.01)

(58) Field of Classification Search
CPC ..... A63B 71/0622
See application file for complete search history.

(56) References Cited

U.S. PATENT DOCUMENTS 5,066,001 A * 11/1991 Wilkinson ..... A63B 6/00 482/52
2006/0246403 A1* 11/2006 Monpouet ..... A63F 3/00643 434/128
2008/0200285 A1* 8/2008 Haseth ..... A63B 63/00 473/422
2010/0038854 A1* 2/2010 Mraz ..... F41J 5/041 273/371
2010/0076347 A1* 3/2010 McGrath ..... A61B 5/1038 600/595
2011/0141052 A1* 6/2011 Bernstein ..... G06F 3/016 345/174
2012/0009996 A1* 1/2012 Masashi ..... A63F 13/005 463/35

(Continued)

*Primary Examiner* — Tramar Y Harper
*Assistant Examiner* — Jeffrey K Wong
(74) *Attorney, Agent, or Firm* — Patents on Demand P.A.; Brian K. Buchheit

(57) ABSTRACT

An athletic training system includes one or more panels having a rigid front surface covered by a translucent material behind which is an illumination or light source and one or more pressure sensors that can detect and measure the pressure caused by impact against the front surface. A control device communicates with and controls the panels according to a selected exercise regimen that is designed to develop particular skills for an athletic or sporting endeavor by commanding the panel or panels to illuminate or display information. While illuminated or displaying, each panel actively monitors its pressure sensor for an indication of an impact, and upon detecting an impact, reports the detection of the impact to the control device, and turns off its illumination. The process of turning panels on and off and detecting impact can be used to construct various regimens for training and developing skills.

23 Claims, 17 Drawing Sheets

(56) References Cited

U.S. PATENT DOCUMENTS

| | | | | |
|---|---|---|---|---|
| 2015/0064676 | A1* | 3/2015 | Carulli | G09B 1/325<br>434/308 |
| 2015/0279170 | A1* | 10/2015 | Gupta | G01V 1/22<br>340/6.1 |
| 2017/0229041 | A1* | 8/2017 | Reichow | A63B 69/00 |

* cited by examiner

METHOD AND APPARATUS FOR A USER-CONFIGURABLE ATHLETIC TRAINING APPARATUS

CROSS REFERENCE

This application is a continuation in part of, and claims priority to, U.S. non-provisional patent application Ser. No. 14/829,407, titled "Method and Apparatus for a User-Configurable Athletic Training Apparatus," filed Aug. 18, 2015, which claimed the benefit of prior U.S. provisional patent application No. 62/038,433 filed Aug. 18, 2014, and the entirety of both prior applications is hereby incorporated by reference.

BACKGROUND

The present disclosure relates generally to athletic and sports training equipment, and more particularly to interactive and user-configurable apparatus that cue a trainee to act, time the response of the trainee or otherwise keep score of correct actions, and determine the validity of the response.

Team sports are widely popular throughout the world, with perhaps the most popular sport being soccer, or football/futbol as it is referred to in other countries. Although team sports require team participation, individual performance is also important for players to contribute to team efforts. In a conventional training regimen players typically train together, performing both team and individual drills that focus on various skills used in the sport. However, without equipment to aid in training, the types of drills and skill techniques that can be practiced by an individual is limited.

Conventional training equipment tends to operate in a manner that results in very repetitive and limited, often by design to force a person to focus on a particular movement or skill. In team sports the conditions during a game or match can be very dynamic, and require the ability of the players to adjust to the conditions, and adjust their technique, as well as make quick judgments about how to best proceed. This type of skill is not well trained by conventional training apparatus that focus on a particular technique, and very often the only way a player can practice under those kinds of conditions is to actually participate in a live team activity.

Furthermore, there is increasing evidence that athletic training can be augmented by coupling it with cognitive exercises, where, in addition to performing physical techniques, the trainee is also required to perform mental tasks unrelated to the athletic training. It is believed that such cognitive activity performed in conjunction with athletic training can enhance a trainee's ability to think strategically and recognize opportunities during athletic matches and contests.

Accordingly, there is a need for a method and apparatus for a modular, scalable system that allows a user to configure interaction parameters such as cue time, randomness, duration, data collection of the results to allow a single player to practice the kinds of skills need for applying more basic skills during a live, dynamic sporting event without actually having a team of players, and to further present cognitive challenges during training unrelated to the training techniques to enhance cognitive abilities of trainees and players.

BRIEF DESCRIPTION OF THE FIGURES

In the accompanying figures like reference numerals refer to identical or functionally similar elements throughout the separate views, together with the detailed description below, and are incorporated in and form part of the specification to further illustrate embodiments of concepts that include the claimed invention and explain various principles and advantages of those embodiments.

Figure 1:
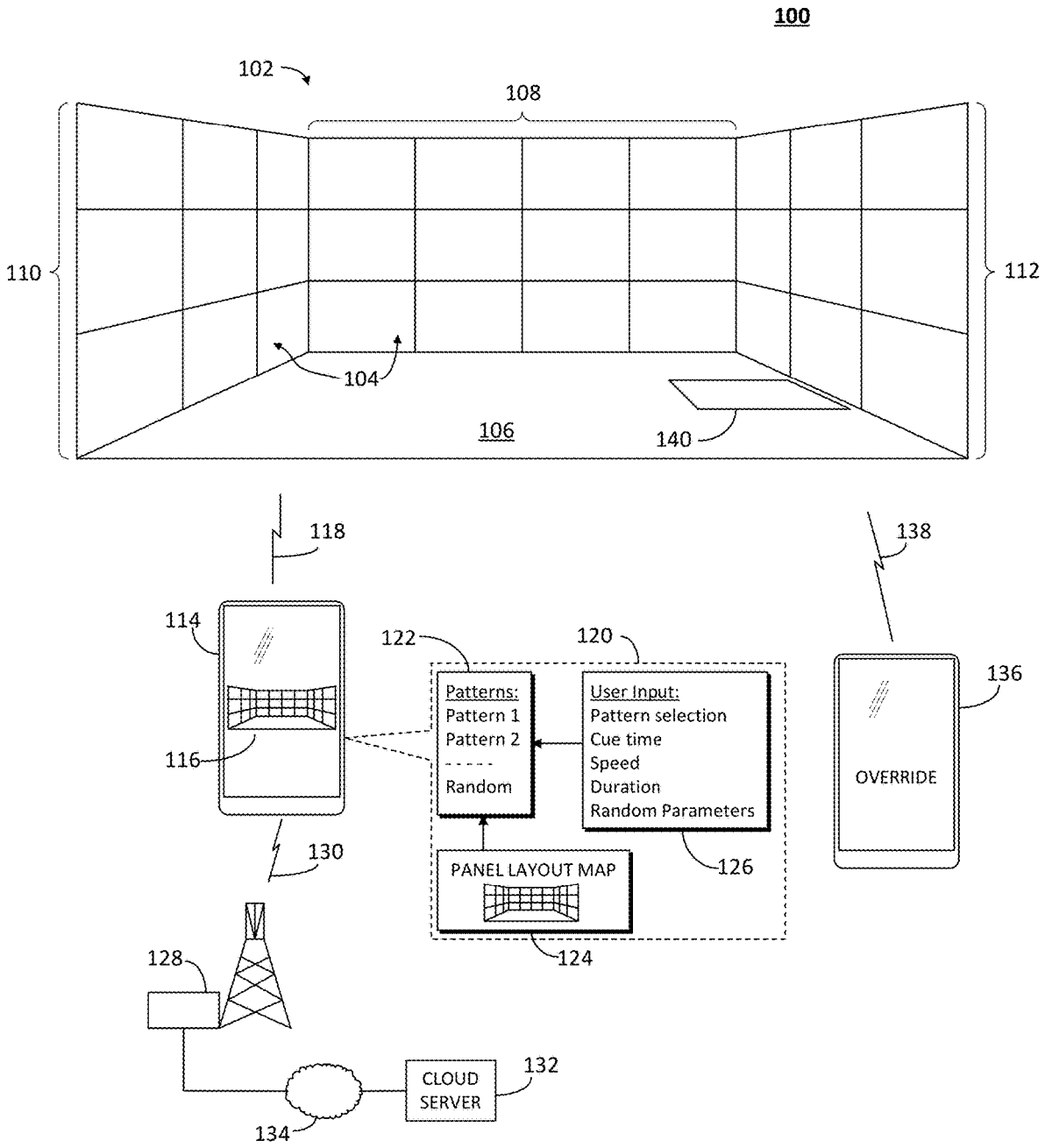
FIG. 1 is a system diagram of a configurable panel-based athletic training system in accordance with some embodiments.

Those skilled in the field of the present disclosure will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein. The details of well-known elements, structure, or processes that would be necessary to practice the embodiments, and that would be well known to those of skill in the art, are not necessarily shown and should be assumed to be present unless otherwise indicated.

DETAILED DESCRIPTION

Embodiments of the disclosure include a user configurable athletic training system that includes at least one panel, where each panel is configured to provide visually distinct output in accordance with selected visual patterns in at least two regions of a front surface of the panel. Each panel is further configured to detect an impact at the front surface of the panel including a location of a point of the impact on the front surface relative to the at least two regions. The panel(s) further include a transceiver for wireless radio communication. The training system further includes a control device that is operably coupled to the at least one panel, and which is configured to, responsive to a user input, communicate training information to the at least one panel that indicates the selected visual patterns to be provided at the at least two regions of the front surface of the at least one panel. The visual patterns relate to a selected training criteria, and the control device is further configured to receive impact information from the at least one panel. Impact information determines whether impact achieved compliance with the selected training criteria, and the user or player can be notified accordingly.

Embodiments of the disclosure also include an athletic training apparatus having a plurality of panels, with each panel including a display component at a front surface of the panel configured to visually display information, at least one pressure sensor to detect an impact at the front surface of the panel, and a wireless network transceiver. Each panel of the plurality of panels receives training information from a control device via the wireless network transceiver. The training information received by each panel is unique among the plurality of panels, and each panel is configured to display its respective training information at its respective display component, then detect an impact at its front surface via the pressure sensor, and to then transmit impact information to the control device upon detection of an impact via the pressure sensor.

Embodiments of the disclosure further includes a method of operating a user-configurable athletic training system. The method can include providing an arrangement of at least one panel, where each panel includes a controllable illumination source that controllably illuminates a front surface of the panel at least two different regions of the front surface. The panel(s) further includes at least two pressure sensors for sensing a pressure input at the front surface of the panel and providing a pressure signal. The panel(s) further include a communication circuit. The method can further commence receiving, at a control device that is in communication with the at least one panel, an input selecting a training regimen. The training regimen specifies information for illuminating the at least two different regions of the front surface of the at least one panel during each of one or more intervals of the training regimen. The control device commands the at least one panel to illuminate the front surface at the two regions according to the regimen. The panel(s), upon being commanded to illuminate, turns on its illumination source, thereby causing the two different regions to be illuminated in a visually distinct manner. The method can further include detecting, via the at least two pressure sensors, an impact at the front surface of the at least one panel, including a location of a point of impact relative to the at least different regions. The method also can include transmitting to the control device an indication of the impact and the location of the impact.

FIG. 1 is a system diagram of a configurable panel-based athletic training system 100 in accordance with some embodiments. The system 100 includes an arrangement of one or more panels 102. As used herein, a panel is defined as an object or device having one or more flat surfaces and including an illumination and/or display source for each surface, and a pressure sensor to detect impact pressure at each flat surface. Generally a panel is configured to be struck by an athletic ball (e.g. soccer ball, football, etc.), and is sized to present a sufficient target. Each panel is separately controllable, and includes an illumination source and a pressure sensor that detects pressure anywhere on its front surface (e.g. surfaces 104). The illumination source lights up the panel when on, and is turned on or off according to a training regimen. In general, when a panel is illuminated, it actively senses pressure at its front surface, and turns off the illumination upon sensing pressure at the front surface, upon being commanded to turn off the illumination, or upon expiration of an internal default timer. The panels 102 can be arranged in a grid including a front wall 108, a left wall 110, and a right wall 112. Each of the walls comprise three horizontal rows of panels that are placed adjacent each other. There may be some gap between the panels 102 in the grid, and in some embodiments the panels may be spaced apart from each other. The walls 108-112 surround a floor 106 on three sides. The floor is where a player or trainee stands or is otherwise located in order to engage the panels 102. In some embodiments one or more floor panels 140 can be provided on a floor or ground surface of the exercise area. The floor mounted panel 140 can be used, for example, as a starting or ending point of the player, sensing the pressure of the player's weight. In general, the panels 102 are selectively illuminated, and upon being illuminated, the person using the system 100 attempts to impart force (i.e. pressure) on the front surface of the illuminated panel or panels, such as by kicking, throwing, or hitting a ball at the illuminated panel or panels. Once hit, the illuminated panel turns off (i.e. no longer illuminated), and another panel is then illuminated for the player to hit. Although a grid including three walls having three rows of panels is shown here, even a single panel can be used by simply varying the time between when its illumination is turned off and then turned back on. Furthermore, the panels can be fabricated in different shapes, and are not required to be rectangular.

The panels 102 can be controlled by a control device 114 which can be a mobile device such as a smart phone, a tablet computing device, a laptop computer, and so on. The control device 114 can include a graphical display for displaying information, such as a representation 116 of the panels 102. The control device 114 includes a wireless transceiver for communicating via a local wireless network channel 118 with each of the panels 102. The control device 114 runs an application 120 or similar program code that includes one or more patterns 122, which represent different types of training regimens, and can include a random function so that training exercises are varied. The control device 114 also includes a panel layout map 124, which is a map of the layout of the panels 102. The map correlates relative locations of the panels (i.e. relative to each other) with each panel's unique address. The panel layout map 124 can be entered manually by a user of the control device 114, or the control device 114 can interrogate and discover panels 102 wirelessly. The user of the control device 114 can also enter information 126 such as a pattern or regimen selection, a cue time for waiting before initiating a training exercise, a speed parameter difficulty level, a duration parameter for the overall duration of the training exercise, and other parameters such for randomizing the training exercise.

The control device 114 can be connected to a wide area network, such as by a cellular telephony data channel 130 to a terrestrial radio network 128, which can be further connected to a wide area network 134 such as the internet. A cloud server 132 connected to the network 134 can be used to store data produced by the control device 114 relating to the results of the training exercises. Information can be stored by user name so that a user or coach can track their performance over time. A coach or supervisor device 136 can access the cloud server 132 to view results for various players logged by control devices such as control device 114. Furthermore, the coach device 136 can, in some embodiments, override the user settings 126 for a given training exercise via a local wireless network channel 138. The override can be used, for example, when a coach decides that the parameters of the training exercise presently commencing is too difficult, or too easy, for the player using the system 100.

Figure 2:
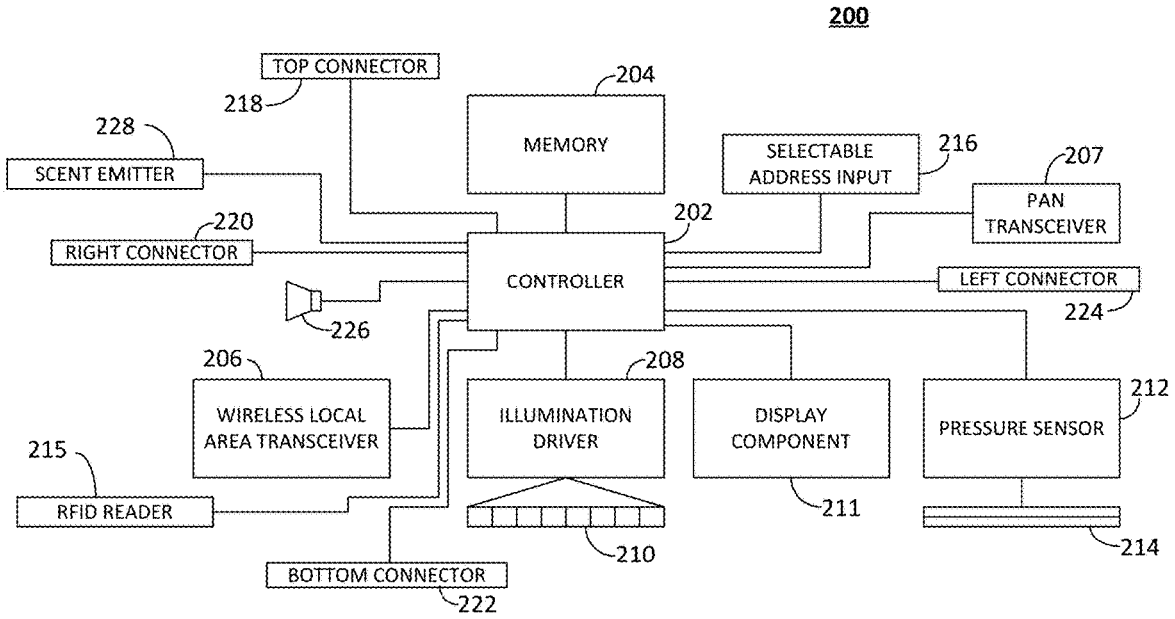
FIG. 2 is a block schematic diagram of an illuminating pressure sensing panel for a configurable panel-based athletic training system in accordance with some embodiments.

FIG. 2 is a block schematic diagram of an illuminating pressure sensing panel 200 for a configurable panel-based athletic training system in accordance with some embodiments. The panel 200 can be powered using a commercial electric power source and an on-board power converter (AC to DC) in some embodiments, but for portability the panel 200 can be battery powered. The panel 200 includes a controller 202, such as a microcontroller or microprocessor, which is connected to memory 204. The memory 204 can represent an aggregate of different types of memory, including long term storage memory for executable instruction code and default data, and "scratchpad" memory for instantiating instruction for execution by the controller 202, as well as variable storage. Accordingly, memory 204 can include read only memory (ROM), random access memory (RAM), programmable memory such as flash memory, and so on. The controller 202 is coupled to a wireless local area network transceiver 206 that can transmit and receive radio signal in accordance with a local wireless network protocol. For example, protocols such as those specified by the Institute of Electrical and Electronic Engineers (IEEE) in specifications 802.11 (commonly referred to as "WiFi") and 802.15 (which includes the protocol known as "BlueTooth"), among other known wireless local area network protocols. The wireless local area network transceiver 206 includes a unique network address such as a media access control (MAC) address, as is commonly used. Furthermore, a separate personal area network (PAN) transceiver 207 can also be present, and coupled to the controller 202. The PAN transceiver 207 can operate using a protocol in compliance with IEEE specification 802.15, such as BlueTooth. In some embodiments a user device such as a cellular phone device can use a PAN protocol to identify each panel in its vicinity, and cause the panels to individually identify themselves such as by illuminating momentarily in conjunction with a selection or display at the user device. The user can use this information to arrange panels in a desired arrangement, designating each panel for a specific location in the arrangement. Such arrangements can be used, for example, for specific exercises, such as traversing a course, where panels can be used to represent targets to which the player must pass the ball (causing an impact on the panel). The panel or panels 200 can use the wireless local area network transceiver 206 to communicate other information, such as impact determinations, as well as to receive information regarding illumination patterns or other information to be displayed.

The panel 200 further includes an illumination source comprised of a driver circuit 208 and illumination output devices 210, such as light emitting diodes (LED). The illumination output devices can light up substantially the entire front surface of the panel by being located behind a translucent or diffusing front surface member that is substantially rigid to allow balls to bounce off the surface much as it would a wall. In some embodiments the illumination output devices 210 can form characters such numeral or alphabetic characters. Furthermore the illumination output devices 210 can produce multiple colors, where different colors can mean different things, such as the panel being a target, or the panel being prohibited (i.e. do not hit). The illumination is controlled by the controller 202 by providing control signals to the illumination driver 208. In addition to the illumination output devices 210, the panel can include one or more display components 211. A display component is used to visually present information or visual media, and can include LED segment or matrix displays, LED video displays, and other types of display components for present information visually on the panel 200.

In order to detect when the panel 200 is struck, a pressure sensor 212 can be coupled to a pressure plate or transducer 214. The pressure transducer 214 can be mounted such that is fixed between a wall behind the panel 200 and the front surface (e.g. the translucent surface member). The pressure transducer 214 can be one or more piezo elements, for example, which are sensed by the pressure sensor 212 for changes in electrical characteristics of the pressure transducer 214. Accordingly, the pressure sensor 212 can detect changes in pressure, such as upon a ball contacting the front surface of the panel, as well as the magnitude of the pressure, which indicates the force of the ball. The pressure sensor 212 can provide information to the controller 202 indicating the occurrence and magnitude of pressure impulses sensed by the pressure sensor at the pressure transducer 214. Upon sensing a sufficient pressure input, the controller can issue an audible alert via a speaker 226, and can provide visual confirmation by, for example, flashing the illumination source 210 briefly. The speaker 226 can also be used to play audio information, such as voice prompts (e.g. "ready, set, go!") as well as music, and audio feedback to indicate success in hitting the panel.

In some embodiments multiple pressure sensors 212 can be used to sense pressure at different locations at the front of the panel 200. Pressure differentials that occur at each pressure sensor 212 can be used to determine the approximate location of an impact on the assumption that the pressure sensors closest to the point of impact will sense the highest pressure or force as a result. Furthermore, the magnitude of the force can be measured based on the impact pressure, and used to derive a velocity or approximate velocity of the ball used in the exercise as long as the mass of the ball is known or approximated. In some embodiments the training criteria can include that the pad be hit with a velocity in a given range to allow the user/trainee to develop muscle memory as to the amount of force to impart into the ball to achieve the desired velocity. Such training can be beneficial, for example, to train passing a soccer ball a certain distance without causing the ball to go past a player, and to improve timing.

A radio frequency identification (RFID) reader can be used to detect the proximity of an RFID tagged device, such as a ball. One application of an RFID reader is to avoid false impact detections. That is, if an impact is detected, but the RFID reader failed to read the RFID tag of the ball, the impact may be ignored and it can be assumed that the impact was caused by something other than the ball being used for the training. In some embodiments the pressure sensor 212 can be a force or strain transducer. In some embodiments the pressure sensor can be an inertial sensor that senses an impact by inertia (e.g. movement or vibration) imparted to the panel resulting from an impact. Like with using several pressure transducers, inertial sensors located at different locations on the panel can produce different inertial readings that can be used to derive the location of an impact, approximately, on the front of the panel.

When multiple panels are used, they can be arranged as shown, for example, in FIG. 1, or in other ordered arrangements. When intended to be used in an ordered arrangement, the control device (e.g. control device 114) controlling the panels must have information about the relative locations of the panels with respect to each other. To facilitate the device (e.g. device 114) generating a layout map of the panels, a selectable address input 216 can be provided which is user configurable. The selectable address input 216 can be, for example, a dual inline package (DIP) switch array including a plurality of switched, where the settings of the switches are set according to a convention to indicate a wall (e.g. left, front, right), a row location and a column location. The selectable address input 216 can be read by the controller 202, and relayed to the device via the wireless local area network transceiver 206. In some embodiments the panels can have connectors at each edge or side, such as a top connector 218, right connector 220, bottom connector 222, and left connector 224. The connectors 218-224 interface with corresponding connectors on adjacent panels, and allow the controller 202 of each panel to determine its location with respect to other panels. For example, a panel on a bottom row would have nothing connected to its bottom connector 222 but would, assuming there is a row of panels above it, sense a connection at its top connector 218, which would be connected to the bottom connector of the adjacent panel above it. The connections made by the connectors allow the panels to determine their location in an arrangement of panels. The connectors can be, for example, configured as universal serial bus (USB) connectors, allowing the panels to communication with each other through the connectors.

In some embodiments, instead of using a wireless local area transceiver, the control device can be connected to the panels by an addressable bus, such as a USB bus, and the panels can likewise be interconnected connected by such a bus. The locations of the panels can be determined by their connection points; a panel with no connections on its bottom connector can assume it is, for example, on a first row as there are no panels below it. If the panel detects another panel connected to its top connector, it can assume that there is at least one row above it, and the panel connected to the top connector can report to the panel below it whether there is another panel connected on top of it, and so on, allowing the panels to determine their arrangement. These mappings can be reported to a control device in order to allow the control device to contract a layout map of panels for implementing various training regimens.

A scent emitter 228 can be used to produce one or more scents to stimulate the olfactory sense of a user. The scents can be produced in correspondence with different stimuli over the course of training, such as lighting, solving puzzles, sounds, and so on.

The panel 200 can be constructed with or without a frame. The frame can be used to facilitate arranging panels in grids or matrices as shown in FIGS. 1, and 3-12. Otherwise a "naked" panel can be placed on a stand.

Figure 3:
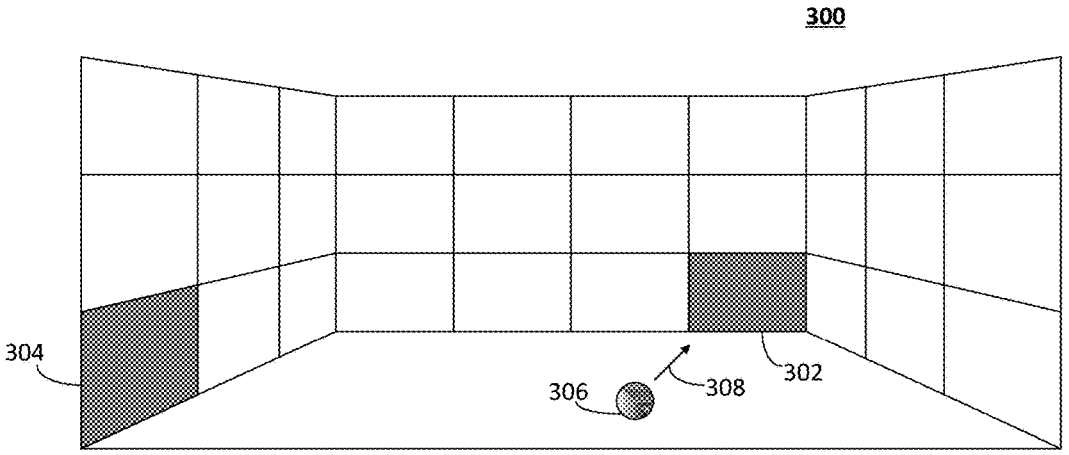
FIGS. 3-5 show a first exemplary training regimen in a configurable panel-based athletic training system in accordance with some embodiments.
Figure 4:
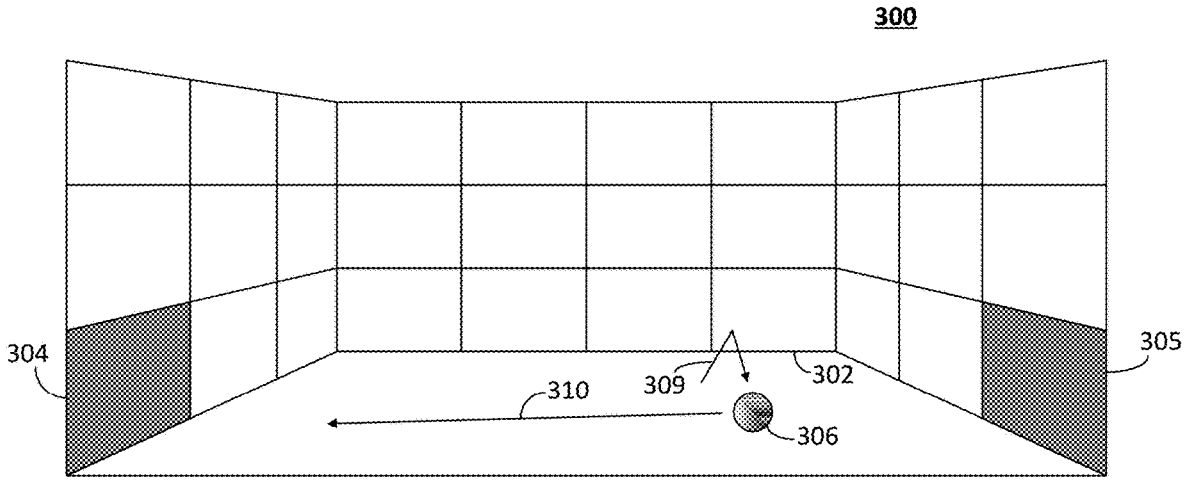
Figure 5:
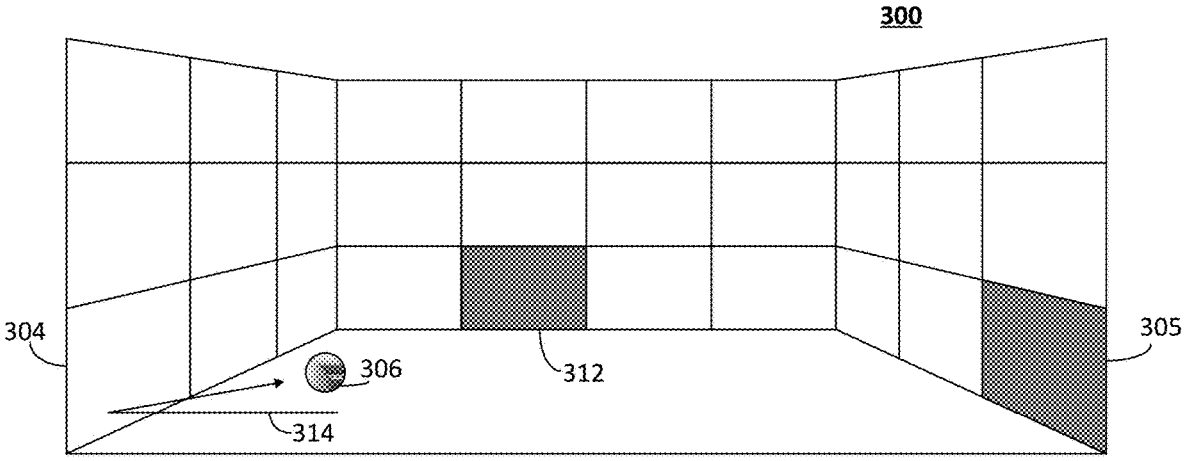

FIGS. 3-5 show a first exemplary training regimen 300 in a configurable panel-based athletic training system in accordance with some embodiments. The exemplary training regimens illustrated herein show the operation of an athletic training system such as that shown in FIG. 1, including a plurality of illuminating pressure sensing, wireless network connected panels. In each training regimen one or more panels are illuminated, meaning the panel's controller causes its illumination source to turn on and emit visible light. When the panel receives an impact, such as upon being hit with a ball, the impact is detected by a pressure sensing system, the illumination is turned off, or changed, to indicate detection of the impact. Thereafter, another panel, or the same panel, can illuminate, as controlled by the control device (e.g. control device 114) that is in communication with the panel or panels.

Accordingly, in regimen 300 a player or trainee uses a ball 306 in a training area similar to that shown in FIG. 1. Upon commencement of the regimen 300, as shown in FIG. 3, panels 302 and 304 illuminate in response to a commend from the control device (not shown). In this exemplary training regimen two panels are always illuminated, and each illuminated panel is a valid target. The player then attempts to direct the ball 306 to impact one of the illuminated panels 302, 304. Specifically, in FIG. 3, the player has chosen to direct (e.g. kick) the ball 306 to impact panel 302 as indicated by line 308. In FIG. 4 line 309 indicates that the ball 306 has impacted and rebounded off panel 302, which is therefore no longer illuminated having sensed the impact. However, panel 304 remain illuminated, and panel 305 becomes illuminated as another potential target, so the player directs the ball to panel 304 as indicated by line 310. In FIG. 5 the ball 306 has rebounded off panel 304, which as a result is no longer illuminated, as indicated by line 314. To continue the regimen, panel 312 is then turned on (i.e. illuminated), leaving panels 305, 312 illuminated as valid targets. The illumination of the panels can be indefinite, i.e. until hit or the regimen is over, or they can be timed such that if no panel is hit within a specified time interval after being illuminated the interval is scored as a failure. Note than in this exemplary training regimen 300 only panels at the floor level are used, which can train skills required for passing a ball to other players in soccer, for example.

Figure 6:
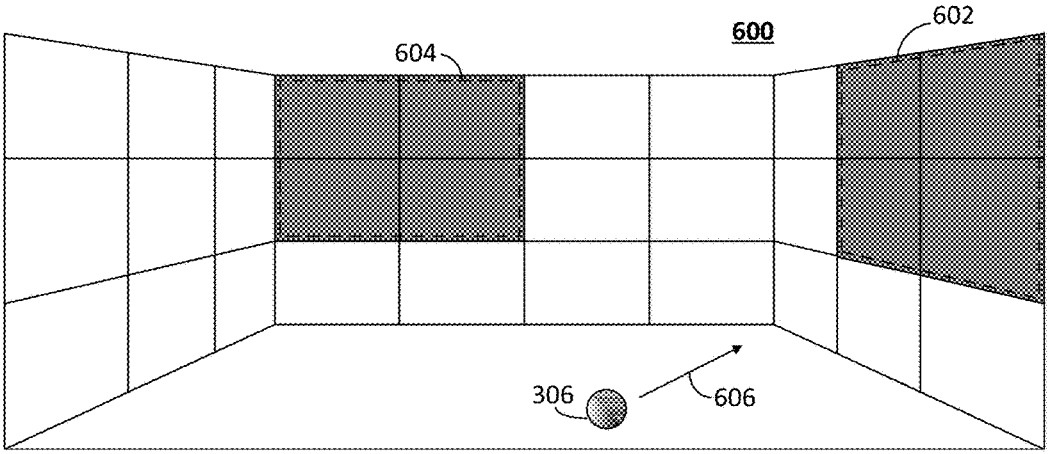
FIGS. 6-7 show a second exemplary training regimen in a configurable panel-based athletic training system in accordance with some embodiments.
Figure 7:
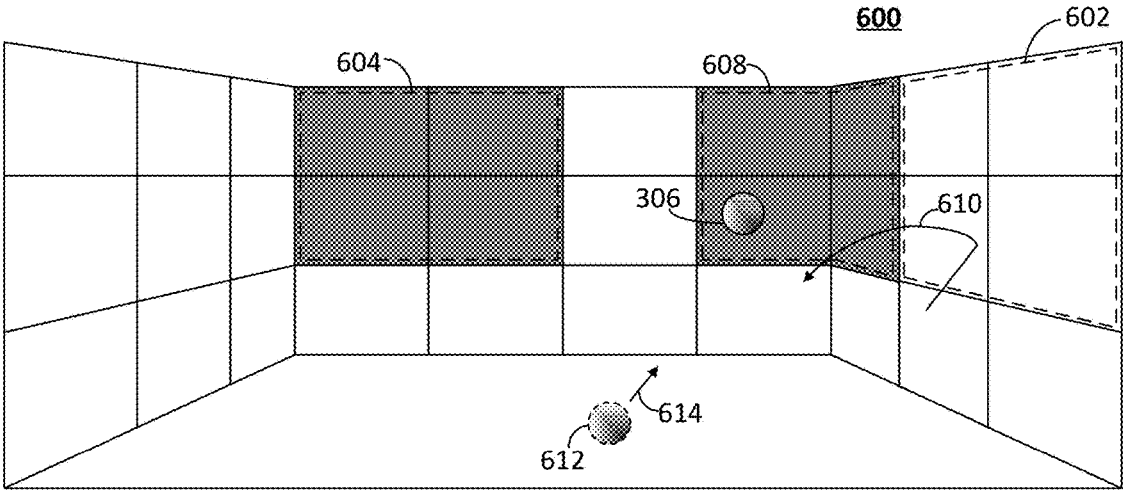

FIGS. 6-7 show a second exemplary training regimen 600 in a configurable panel-based athletic training system in accordance with some embodiments. Regimen 600 illustrates how panels can be grouped together to form a target. Groups 602 and 604 each consist of four panels that are all illuminated as part of the group, and hitting any one of the panels in groups 602, 604 with the ball 306 turns off the entire group (i.e. each panel turns off its own illumination). Furthermore, groups 602, 604 do not include any panels at the floor level, which requires the player to get the ball 306 airborne. In FIG. 6 the player has chosen group 602, and kicks the ball 306 upwards towards group 602, as indicated by line 606. In FIG. 7, after hitting one of the panels in group 602, causing the panels in group 602 to each turn off their illumination, the ball rebounds as indicated by line 610, and can fall back to position 612. In response to group 602 turning off, a new group of panels, group 608, becomes illuminated in a corner of the area. The panels in group 604 remain illuminated. For a second target to hit, the player can chose group 608, as indicated by line 614, causing the ball 306 to impact a panel in group 608. As in the first regimen 300, the process can continue until some end criteria is reached or the user simply ends the exercise. Every time one panel in a group is impacted, the panels in the group are all collectively turned off (i.e. illumination source is powered off), and the controlling device (i.e. device 114) selects another group, or the same group, to be illuminated as another valid target.

Figure 8:
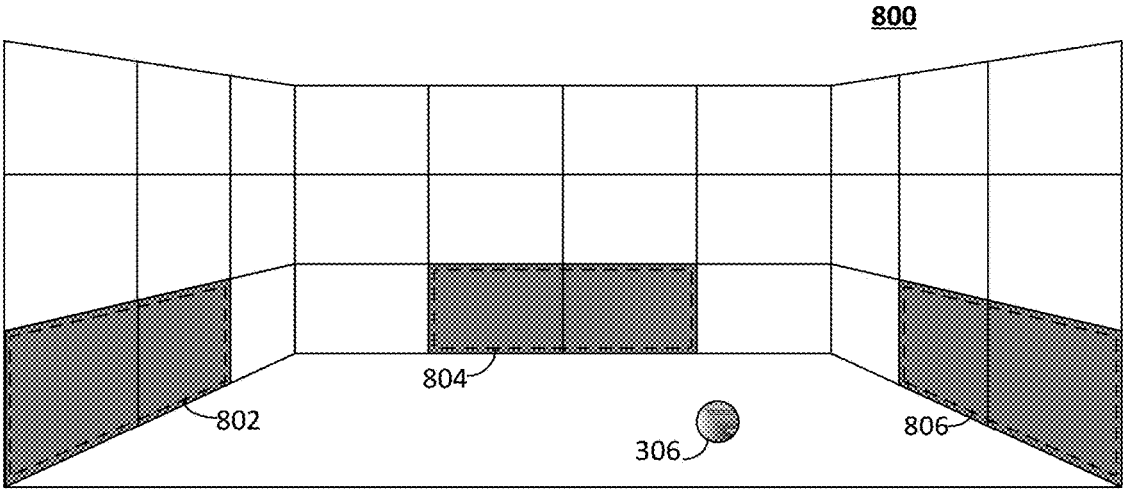
FIGS. 8-10 show a third exemplary training regimen in a configurable panel-based athletic training system in accordance with some embodiments.
Figure 9:
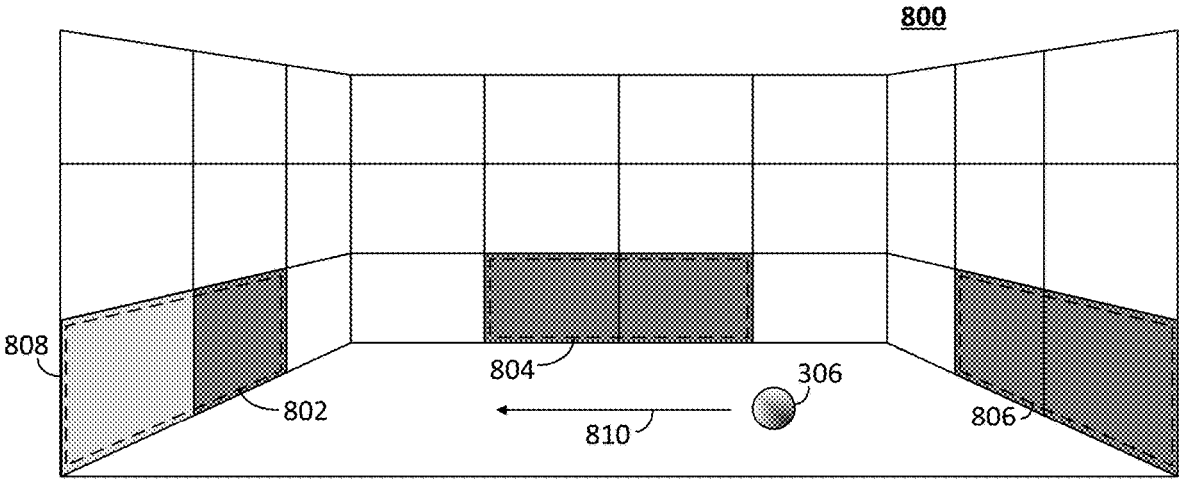
Figure 10:
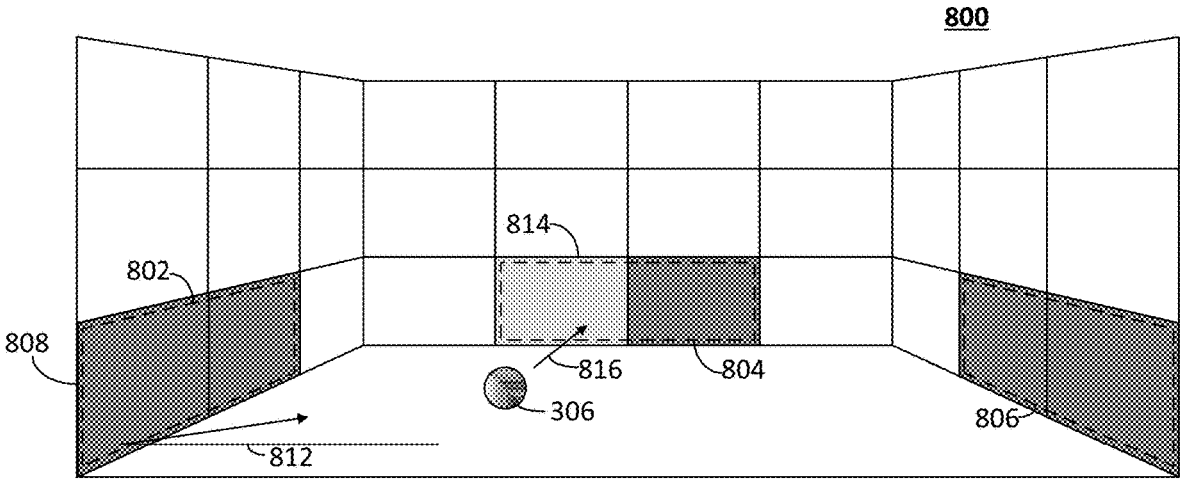

FIGS. 8-10 show a third exemplary training regimen 800 in a configurable panel-based athletic training system in accordance with some embodiments. Regimen 800 utilizes multiple colors of illumination where one color represents a valid target, and another color represents a prohibited target. Non-illuminated panels are neutral, and are neither valid or prohibited targets (as in the previously discussed regimens). In FIG. 8 the regimen 800 is commenced by illuminating three groups of panels 802, 804, 806 completely in the prohibited color. That is, each panel in groups 802-806 are controlled to illuminate in the prohibited target color. After a random initial cue time, in FIG. 9 the regimen commences by changing the color of one panel in one of the groups. Specifically, panel 808 of group 802 is changed from the prohibited color to the valid color. The player must cause an impact on panel 808, without hitting any panel illuminated in the prohibited color. Accordingly, the player can, for example, kick ball 306 towards panel 808 as indicated by arrow 810. If panel 808 is struck, a success is scored for the interval, but if the other panel in group 802 is instead struck, then a failure is logged for the interval. Assuming success in hitting panel 808, the regimen continues in FIG. 10 were panel 814 of group 804 is changed from the prohibited color to the valid color. Accordingly, the player then kicks the ball 306 at panel 814 for the next interval. The regimen 800 can continue like this where a success or failure is scored for each interval, an interval being the time during which the panels are illuminated in a particular pattern unit either a success or failure occurs, or a preselected time period elapse without either a success or failure.

Figure 11:
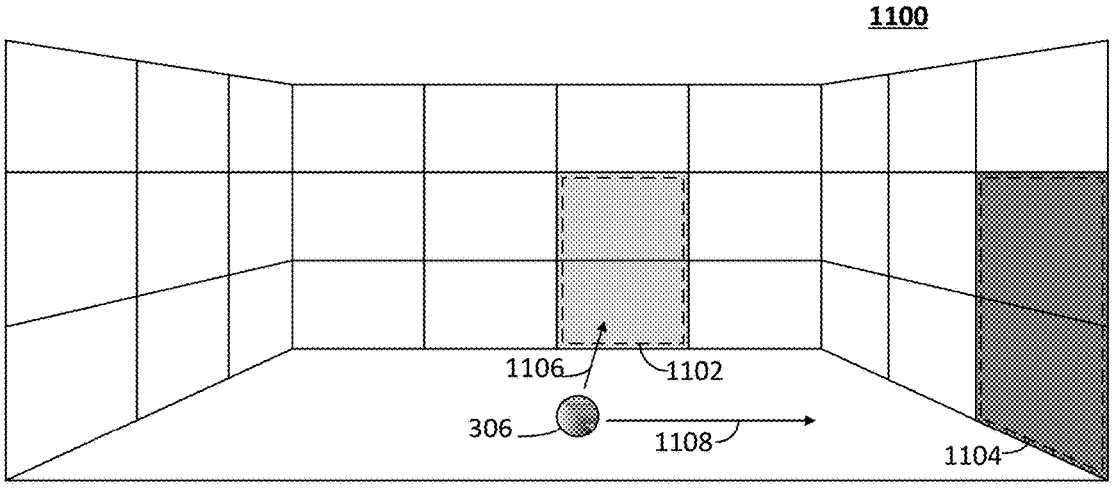
FIG. 11 shows a fourth exemplary training regimen for a multi-player scenario in a configurable panel-based athletic training system in accordance with some embodiments.

FIG. 11 shows a fourth exemplary training regimen 1100 for a multi-player scenario in a configurable panel-based athletic training system in accordance with some embodiments. Regimen 1100 illustrates the use of multicolor illumination for multiple players. Accordingly, a first color can be designated for a first player while a second color can be designated for a second player. An impact on a panel illuminated with the first color is scored as a success for the first player, while an impact on a panel illuminated with the second color is scored as a success for the second player. In the particular example of FIG. 11, a first group of panels 1102 is illuminated with the first color, while a second group of panels 1104 is illuminated with the second color. A first player then wants to kick the ball 306 into the first group 1102, while a second player attempts, at the same time, to take control of the ball and kick it into impact with one of the panels of the second group 1104, as indicated, respectively, by lines 1106, 1108. When a player scores success, another group of panels can be illuminated with the color corresponding to that player, and the regimen 1100 can continue on as such.

Figure 12:
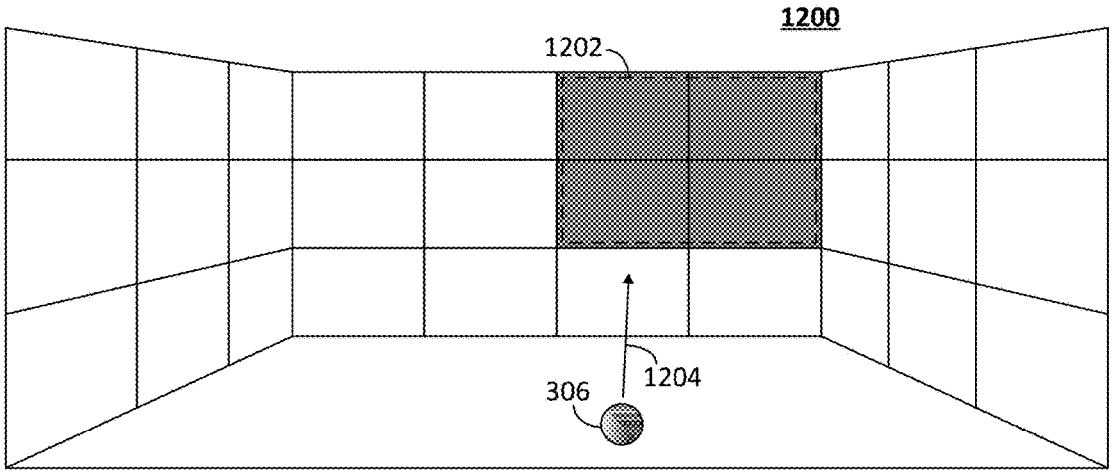
FIG. 12 shows a fifth exemplary training regimen in a configurable panel-based athletic training system in accordance with some embodiments.

FIG. 12 shows a fifth exemplary training regimen in a configurable panel-based athletic training system in accordance with some embodiments. Regimen 1200 illustrates a single player regimen where only a single panel or group of panels 1202 is illuminated at a time. Thus regimen 1200 can be an example of an exercise designed to develop strength and power in the player's technique, rather than a skill that emphasizes timing and handling as exemplified in other regimens discussed. In particular, a goal of regimen 1200 can be for the player to cause the ball 306 to hit the valid target, one of the panels in group 1202, with a minimum force. The pressure sensing subsystem of each panel can measure the degree of pressure caused by the impact. If an impact is received that exceeds the minimum pressure, then a success is logged for the interval. An impact that results in a pressure lower than the minimum can either be ignored or scored a failure. Once a success, or a failure, occurs, the group 1202 can be turned off, and other group can be illuminated. It will be appreciated that groups can be of different sizes, from a single panel to several panels or even all panels. Systems using fewer panels will have fewer options, of course, but the regimen 1200 can be commenced even with a single panel.

Figure 13:
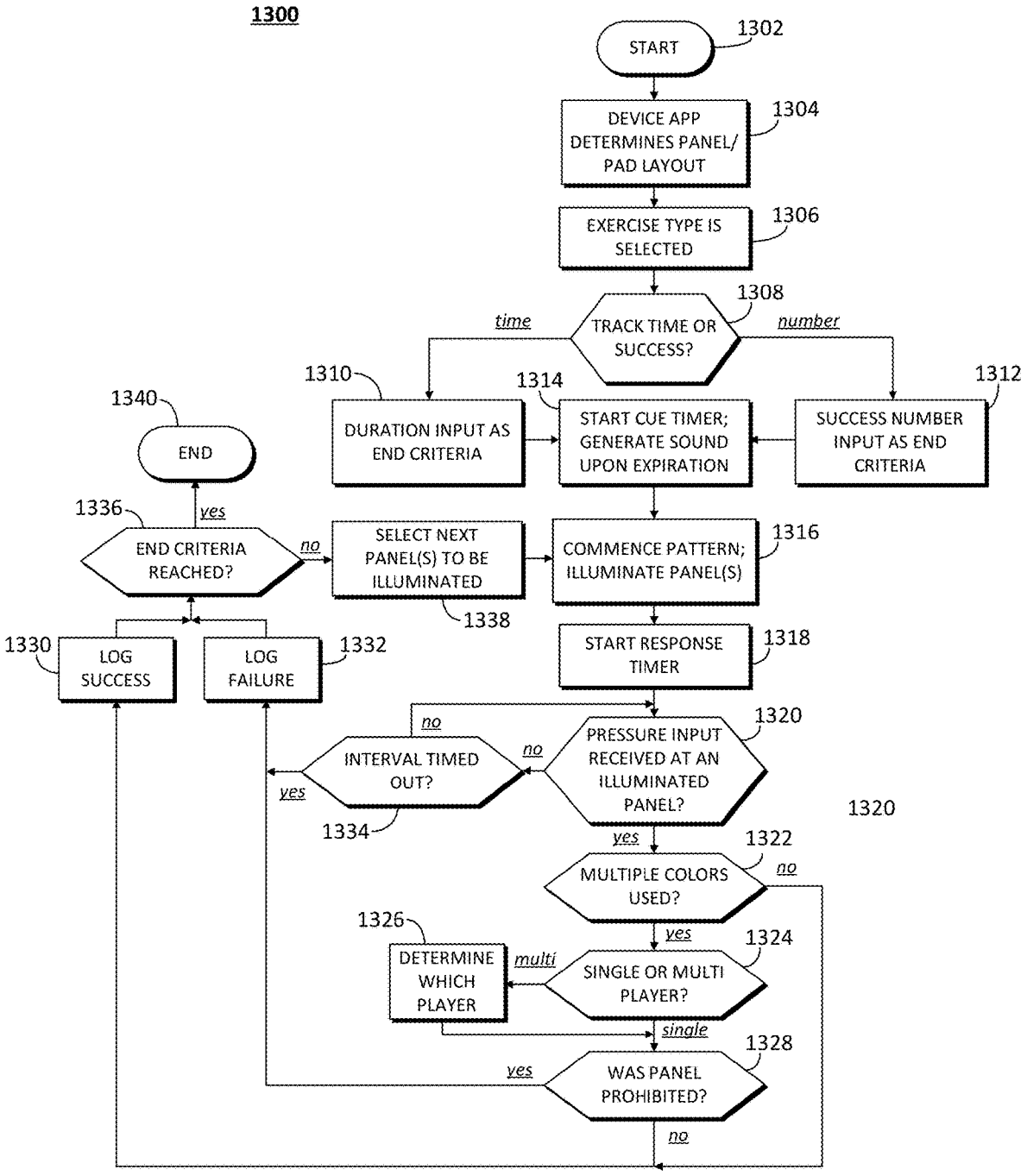
FIG. 13 is a flow chart diagram for method of operating a configurable panel-based athletic training system in accordance with some embodiments.

FIG. 13 is a flow chart diagram for method 1300 of operating a configurable panel-based athletic training system in accordance with some embodiments. At the start 1302 the system is powered up, meaning both the control device (e.g. control device 114) and the panel or panels are powered and ready for use. A first step 1304 include the control device determining the panel layout. The control device can, for example, transmit a wireless beacon, causing the panel or panels to respond, giving some indication of their relative location with respect to each other. In some embodiments a grid address convention can be used where a wall, row, and column parameter can be indicated in a panel's address information. Alternatively, the panel or panels can simply respond as being present, and the user of the control device can input information for each discovered panel regarding its relative location.

In step 1306 the user of the control device can select an exercise or regimen to be used. In step 1308 the user can provide an indication of the regimen end criteria, such as a maximum duration of time, or a number of successes. Accordingly, if time is selected, then the method proceeds to step 1310 where the input time value is used as an end of regimen criteria. If in step 1308 a number of successes is indicated as an end of regimen criteria, the method proceeds to step 1312 where the number of successes indicted is input as the end of regimen criteria. In step 1314 the regimen is commenced by a cue timer where a ready sound can be played, or some other "get ready" indication can occur (e.g. blinking a panel's illumination on and off). In step 1316 the regimen is commenced by illuminating one or more panels in one or more groups, depending on the selected regimen. What occurs is that the control device determines which panels are to be illuminated, and sends a signal via the wireless local area network protocol to the selected panel or panels to turn on their illumination, and the color of the illumination in a multicolor regimen. Using the wireless local area network protocol, the panel or panels can acknowledge the command and indicate compliance/success in turning on their illumination. In step 1318 the control device, or each panel, or both, can commence a response timer to measure the time from being illuminated to receiving an impact. If the control device operates the response timer than it depends on receiving an indication of an impact, via the wireless local area network protocol, from an impacted panel in order to stop or otherwise note the response timer value.

In step 1320 the method 1300 determines whether a pressure input, i.e. an impact, is received at one of the illuminated panels. A non-illuminated panel will ignore impacts. Upon being struck or otherwise receiving an impact, an illuminated panel transmits an impact message to the control device via the wireless local area network protocol. The method 1300 loops between steps 1320 and 1334 while no impact is detected. Step 1334 determines whether an interval timer has expired, meaning that the maximum time for the player to hit an illuminated panel has expired. If no maximum interval time is selected then step 1334 can be skipped, and step 1320 simply keeps repeating. Upon an impact being detected, the method 1300 proceeds to step 1322 where it is determined if multiple colors are being used. If the regimen is not a multicolor regimen, then the method proceeds to step 1330 and a success is logged. If the regimen is a multicolor regimen, then it is determined whether it is a single or multiplayer regimen in step 1324. If it is a multiplayer regimen, then the method proceeds to step 1326 where the color impacted is determined. In step 1328 the method 1300 determines whether the impacted color is a prohibited color or not. In a multiplayer regimen, four colors of illumination can be used, where there is a valid and prohibited color for each of two players, for example. If the impacted panel was a prohibited color, then the method proceeds to step 1332 where failure is scored for the corresponding player (or simply the player in a single player regimen). In some embodiments upon the pressure being detected in step 1320, or upon scoring a success or failure in steps 1330, 1332, a panel can provide an audible indication of the success or failure, and/or the panel can flash its illumination to indicate success or failure.

The various exemplary regimens of FIGS. 3-12 show static regimen where a target stays illuminated until at least some panel is impacted. However, it will be appreciated that, in a multi-panel system, panels can be controlled to simulate a moving target. Upon being illuminated, a short interval time is selected, and upon expiration of the interval time the panel is commanded to turn off while an adjacent panel is commanded to turn on. A succession of a series of adjacent panels can be turned on and off such that the illumination simulates movement across a training area. The player must than anticipate which panel will be illuminated upon throwing or kicking the ball 306 such that the panel with which the ball makes contact is illuminated at the time of contact. Furthermore, while discussed with regard to soccer, it will be appreciated that various regimen can be designed or used for different sports, including American football, and other sports. Additionally, while the panels of FIGS. 1, and 3-12 are presented as a grid, where each panel is abutting adjacent panels, it will be appreciated that panels can be spaced apart, and even facing in different directions. Thus, a similar benefit can be had without necessarily have a wall covered with panels.

Once either step 1330 or 1332 are performed, a present interval is concluded, and the method can commence to step 1336 where it is determined whether the end criteria (e.g. conditions indicated in either step 1310 or 1312) have been met. If so, then the method 1300 ends 1340. If not, then another interval can be commenced by proceeding to step 1338 where the control device selects the next panel or panels to be illuminated, or if a single panel is used, a backoff time period can be selected before the panel is illuminated. The method then commences to step 1316 and another interval is commenced by repeating a portion of the method (e.g. steps 1318-1336). The results of the regimen can, in step 1340, be uploaded to a server for storage and perusal by others, such as a coach or other supervisory entity.

Figure 14:
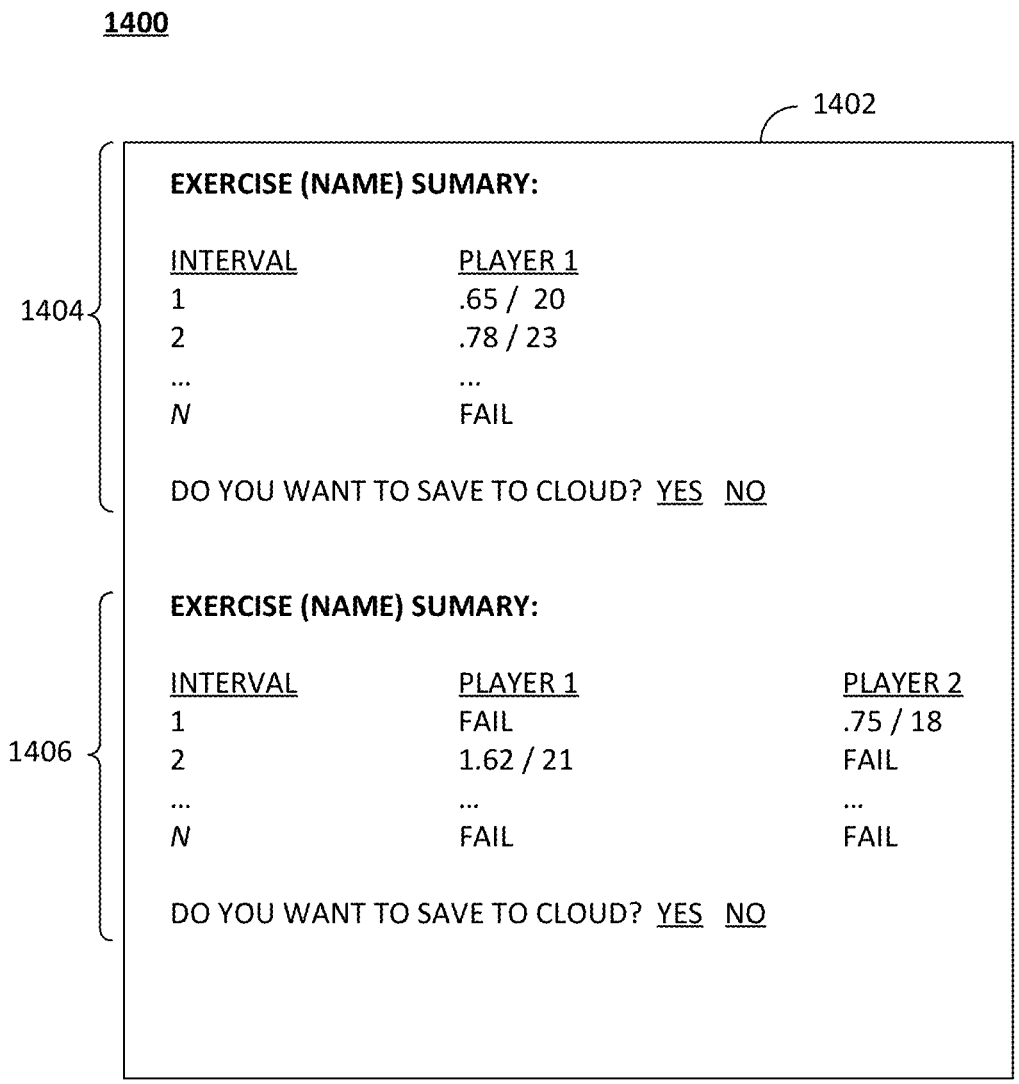
FIG. 14 shows an interface that displays results of a training regimen of a configurable panel-based athletic training system in accordance with some embodiments.

FIG. 14 shows an interface 1400 that displays results of a training regimen of a configurable panel-based athletic training system in accordance with some embodiments. The display 1400 can be presented, for example, on a graphical display 1402 of a control device, or some other device accessing a record of a player of players' results. A first portion or record 1404 shows, as an example, the exercise or regimen name, the various intervals, and a response time and pressure level for the response. So, for interval 1 of the regimen in record 1404, the player had a response time of "0.65" seconds, and an impact pressure of "20" lbs. The record 1404 can include N intervals, and in the Nth interval there is a failure indicated. An option to save the results can be presented (i.e. "do you want to save to cloud") with hyperlinks for "yes" and "no," respectively. If "yes" is selected then the information of record 1404 can be uploaded to a server for storage. If "no" is selected then no action is taken and the user can proceed to another display to commence another regimen, or exit the application on the control device. In record 1406 the results of a two player regimen are shown in accordance with some embodiments. For each interval, when one player succeeds the response time and pressure are shown for the succeeding player, and a fail is scored for the other player. Similarly, in some regimens, both players can fail if no player manages to strike their respective panels, and an option to upload the results can be provided.

Figure 15:
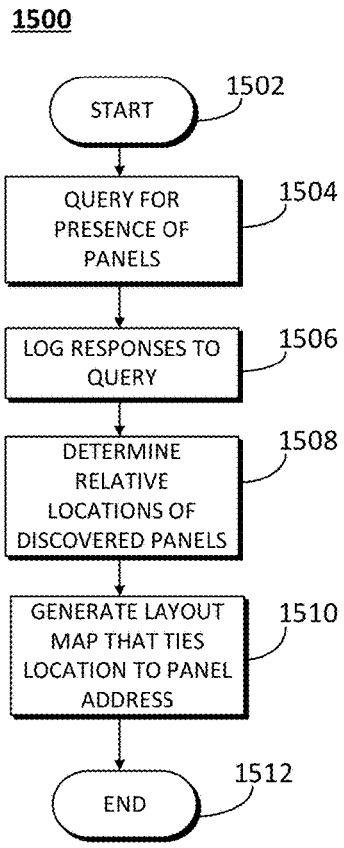
FIG. 15 shows a flow chart diagram of a method of setting up a configurable panel-based athletic training system in accordance with some embodiments.

FIG. 15 shows a flow chart diagram of a method 1500 of setting up a configurable panel-based athletic training system in accordance with some embodiments. At the start 1502, the control device and panels are powered on. In step 1504 the control device transmits a beacon or query, requesting the panel or panels respond. The query is transmitted, for example, via a wireless local area network protocol. Each panel that receives the query can respond. The responses can be conducted using a media access protocol to avoid the panels "talking over" each other. In step 1506 the control device logs the responses from the panel or panels. The responses each indicates a relative location, if there are multiple panels. For example, the responses can use an addressing convention such as indicating a wall, a row, and a column in a grid pattern, or another addressing convention. In step 1508 the control device determines the relative location of each discovered panel, and in step 1510 the control device generates a layout map that correlates location with an identifier of the panel such as a MAC address. Once the layout map is generated the method ends 1512 and an exercise regimen can then be selected and commenced using the layout map to control the various panels.

Figure 16:
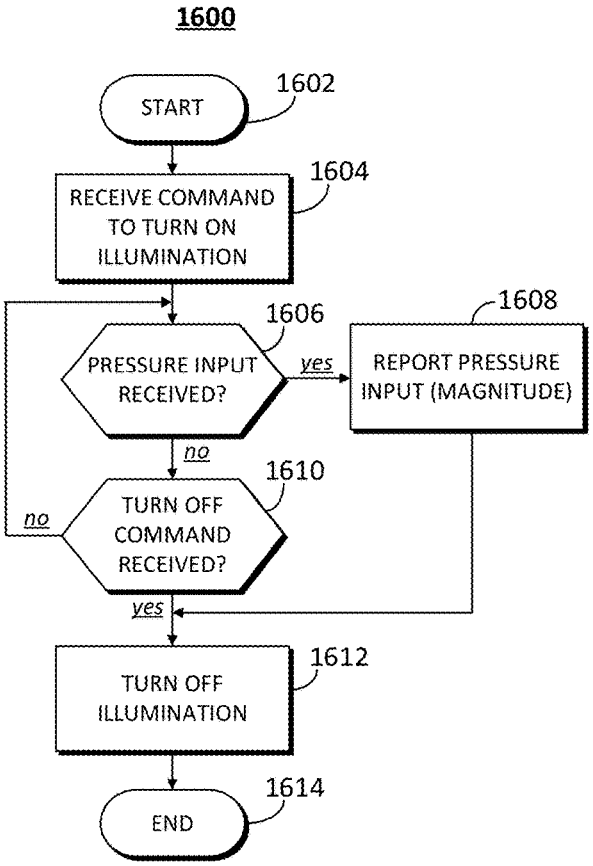
FIG. 16 shows a flow chart diagram of a method of operating an illuminating pressure sensing panel in accordance with some embodiments.

FIG. 16 shows a flow chart diagram of a method 1600 of operating an illuminating pressure sensing panel in accordance with some embodiments. At the start 1602 the panel is powered on, and its location with respect to other panels, if any, has been determined by the control device. During the course of an exercise regimen, the panel may be commanded to turn on, meaning to turn on its illumination source device, as in step 1604. Until and unless such a command is received, the panel remains neutral and not illuminated. The command can be received via a wireless local area network protocol message addressing the panel specifically, either as an individual or as part of a group of panels, and it can also indicate a color of illumination. Upon being commanded to turn on its illumination, the panel then turns on its illumination source to the indicated color, if any, and monitors its pressure sensor in step 1606. While no pressure input is received, the method can also monitor for a turn off command message in step 1610. The panel remains illuminated while no pressure input and no turn off command are received. If a pressure input is received, i.e. the panel is struck at its front surface, then in step 1608 the panel can report the pressure input and magnitude of the pressure in a message to the control device sent via the wireless local area network protocol. Furthermore, after detecting the pressure input, the panel can turn off its illumination in step 1612. Likewise, if no pressure input is received, and the panel receives a turn off command in step 1610, the panel can commence to step 1612 and turn off its illumination. A turn off command can also be received if a different panel in a group to which the illuminated panel belongs reports an impact. Once the illumination is turned off the method then ends 1614 for the present interval of the regimen. The panel exemplified in method 1600 can perform method 1600 again in a subsequent interval of the same regimen.

Figure 17:
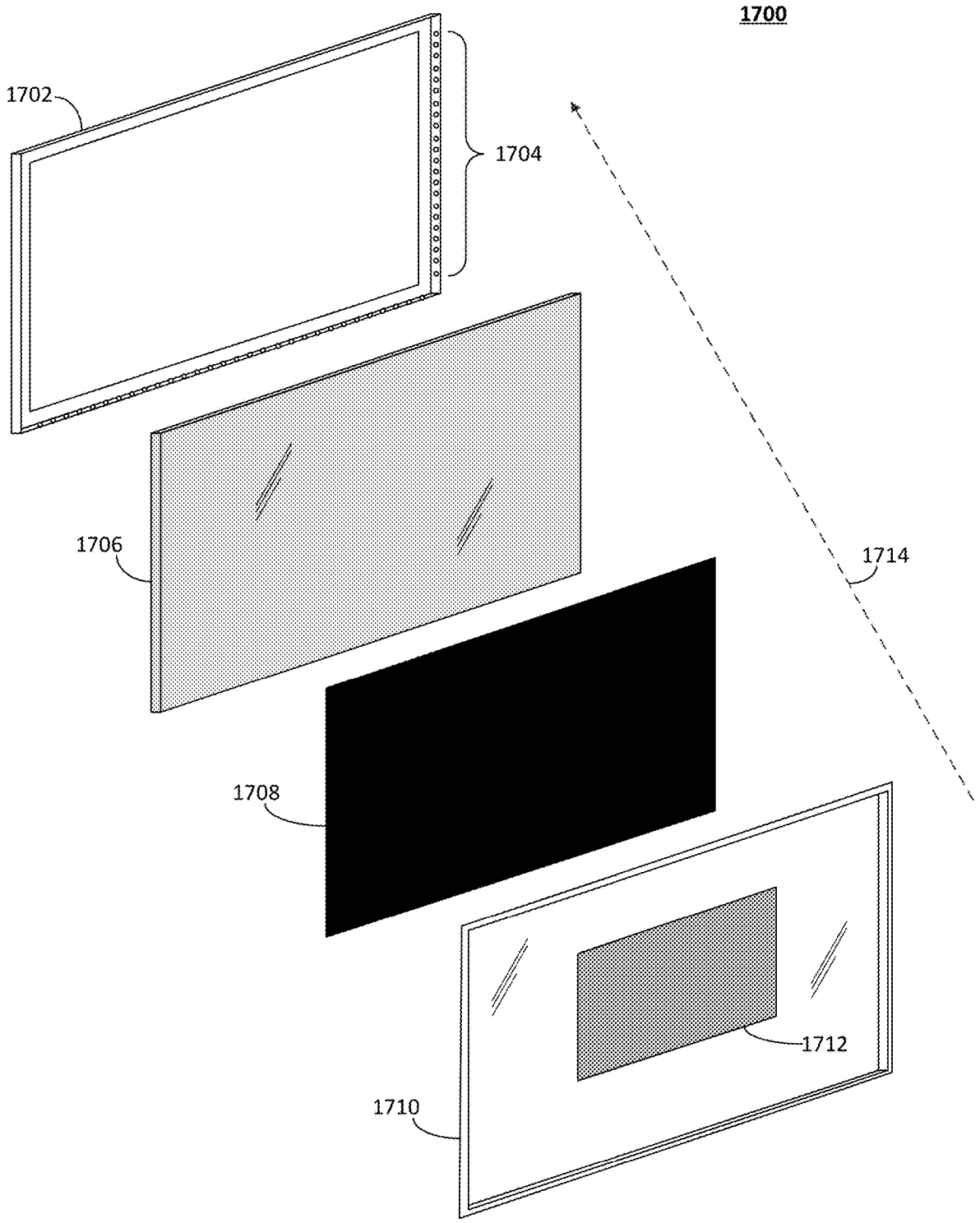
FIG. 17 shows a rear isometric exploded view of an illuminating pressure sensing panel in accordance with some embodiments.

FIG. 17 shows a rear isometric exploded view of an illuminating pressure sensing panel 1700 in accordance with some embodiments. The panel 1700 construction illustrated here can be the same as that used for panels shown in FIGS. 1, 3-12, and 18-21 herein. The panel can include an outer frame member 1702 which has inner edges in which a plurality of illumination sources such as LEDs 1704 can be mounted. The LEDs 1704 can be mounted on all four inner edges, and are arranged on the inner edges to shine inward, relative to the inner edge on which they are mounted. The LEDs 1704 can include LEDs of different colors in order to produce different colors of light. A translucent front surface member 1706 can be mounted in the outer frame member, and sized such that light from the LEDs 1704 shine into the translucent material of the translucent front member 1706. Being translucent, the light from the LEDs 1704 is diffused throughout the translucent front surface member 1706 such that when the LEDs are turned on, the translucent front surface member 1706 appears to light up with the color produced by the LEDs 1704 when viewed from the front of the panel. The translucent front surface member can have a textured front surface (facing away, as shown in this view), and is made of a flexible material such as a polymeric material. One or more pressure plates 1708 are mounted behind, and in contact with the translucent front surface member 1706. A front of the pressure plate can be painted or treated to reflect light to optimize the illumination of the translucent front surface member 1706 by the LEDs 1704. Upon a ball striking the front surface of the translucent front surface member 1706, the impact will impart force through the translucent front surface member 1706 an into the pressure plate 1708, causing a change of electrical characteristics of the pressure plate 1708, which can be detected by a pressure sensing circuit (e.g. circuit 212). To support the pressure plate 1708, an inner frame member 1710 provides rigid support and backing for the pressure plate 1708 and translucent front surface member 1706, as well as capturing these components in the external frame member 1704, such as by screws or bolts that attach the inner frame member 1710 to the outer frame member 1702, and the components 1702, 1706, 1708, and 1710 are assembled in the direction of line 1714. A circuit board 1712 can be mounted behind the inner frame member 1710 to support the circuitry that operates and powers the panel 1700, and which controls the LEDs 1704 and interfaces with the pressure plate(s) 1708 to sense pressure.

In some embodiments, the panel 1700 can be constructed without an external frame member 1704 where the circuitry and other components are housed in a structure that attaches to the cover or front surface member. In some embodiments the panel construction can be such that the panel can be used both with and without an external frame member where the external frame member allows the panel to be hung on a wall, and where a panel can be placed in a stand without needed to use the external frame member when used alone or in conjunction with a small number of other panels at or near ground level.

Figure 18:
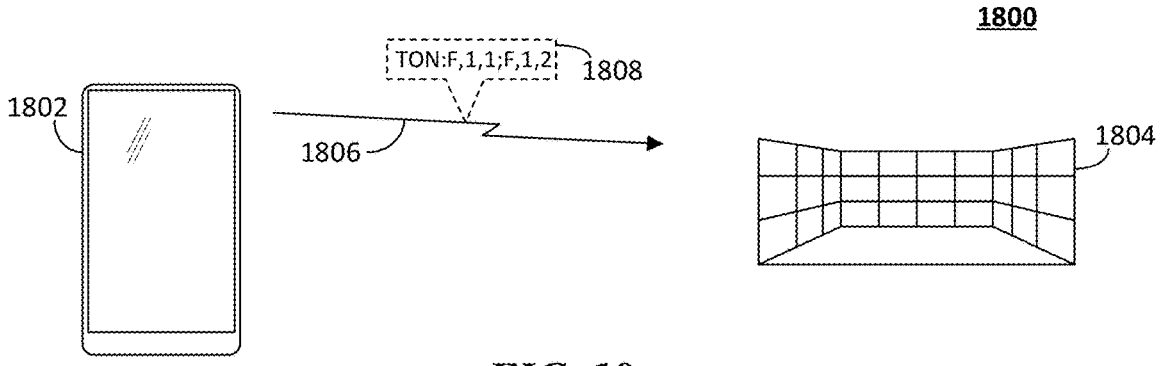
FIGS. 18-21 show a sequence of messaging between a control device and several illuminating pressure sensing panels during an exercise regimen, in accordance with some embodiments.
Figure 19:
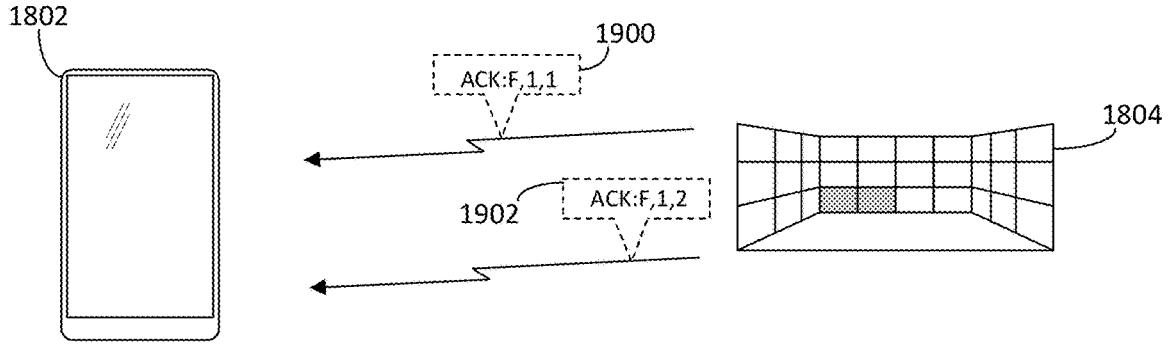
Figure 20:
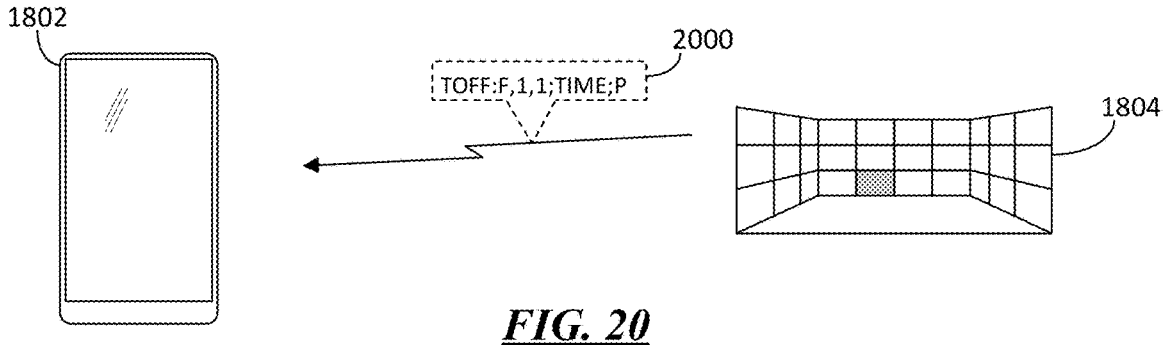
Figure 21:
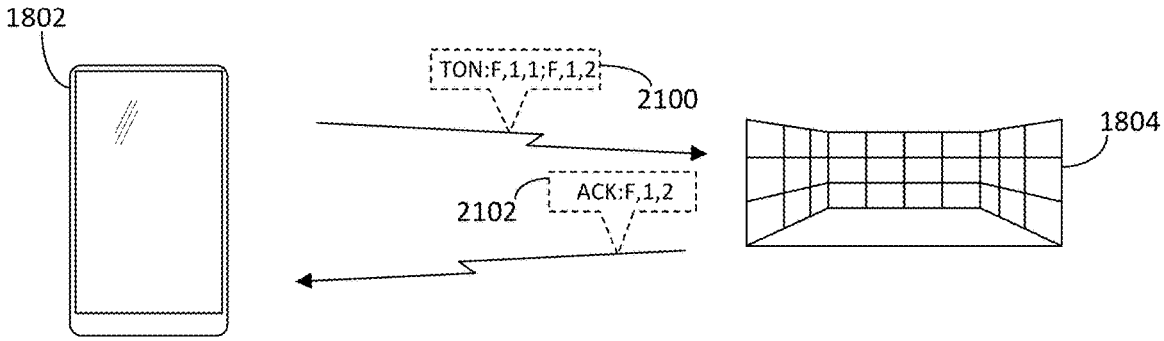

FIGS. 18-21 show a sequence 1800 of messaging between a control device 1802 and several illuminating pressure sensing panels 1804 during an exercise regimen, in accordance with some embodiments. In FIG. 18 the panels 1804 are set up and ready for operation, and the control device 1802 has acquired a layout map of the panels 1804. To commence the regimen, the control device messages one or more panels with a command to turn by transmitting a signal 1806 that conforms to a wireless local area network protocol. The signal 1806 contains a message 1808 including a turn on command ("TON"), and which identifies the panels subject to the command, which in this example includes a panel on the front wall, first row, and first column ("F,1,1"), and another panel on the front wall, first row, second column ("F,1,2"). In FIG. 19 the two panels are then illuminated, and each responds with an acknowledgement message ("ACK") and their address or location (e.g. "F,1,1") so that the control device knows the panels have received and complied with the command. In FIG. 20 one panel has received an impact, and as a result has turned off. To indicate such, the panel transmits a message 2000 to the control device 1802 indicated it has turned off ("TOFF") along with its identifier, and can also include a time parameter ("TIME") indicating the time between turning its illumination and sensing the impact, and a pressure parameter ("P") indicating the magnitude of the sensed pressure. FIG. 21 shows an example of the expiration of an interval without any further impacts on illuminated panels occurring. The control device 1802, upon determining that the interval time has elapsed, transmits a message 2100 commanding the remaining panel to turn off. In response, the panel turns off its illumination and responds with an acknowledgement message 2102.

Figure 22:
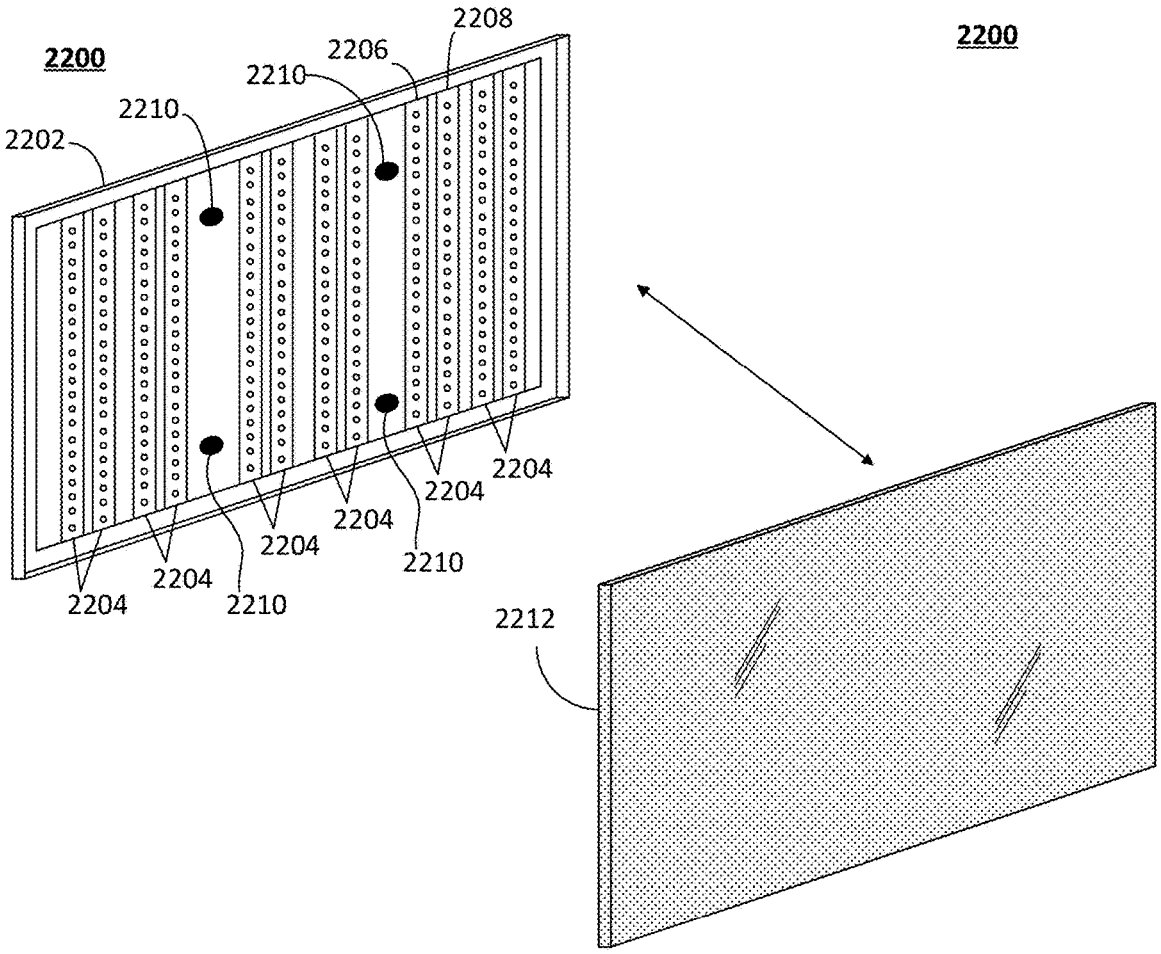
FIG. 22 shows an exploded isometric view of an illuminating pressure sensing panel in accordance with some embodiments.

FIG. 22 shows an exploded isometric view of an illuminating pressure sensing panel 2200 in accordance with some embodiments. The panel 2200 is an alternative construction to that shown in FIG. 17, and includes a frame 2202 that houses several LED strips 2204. The LED strips 2204 include a series of LEDs arranged in a line (vertically here). The LED strips here are arranged in pairs of different colored LEDs, such as, for example, a red LED strip 2206 alongside a green LED strip 2208. Additional LEDs can be arranged elsewhere in the panel 2200, such as around the perimeter of the frame 2202 as shown in FIG. 17.

The cover 2212, which is assembled into the front of the frame 2202, is both impact resistance and light transmissive to allow light from the LED strips 2204 to pass through and be seen by people. The cover 2212 can be textured to be light diffusing (e.g. with a prismatic texture on its back or interior surface) so that the individual LED strips are not visually apparent to people when looking at the panel 2200. The cover 2212 must be thick enough to be sufficiently rigid such that impacts do not damage the LED strips and the cover 2212 does not crack when receiving impacts that can occur during ordinary usage.

The cover 2212 can be mounted on sensors 2210 that separate the cover 2212 from the LED strips 2204. The sensors 2210 can be, for example, pressure or inertial sensors that can indicate the force resulting from an impact at a given location on the front of the panel. When an object impacts the front/exterior surface of the cover 2212, the impact force is independently sensed by each of the sensors 2210, allowing a rough determination as to where on the cover 2212 the impact occurred. More particularly, the pressure sensors can be arranged to detect which half (e.g. right or left) of the panel was struck, such as by a ball during an exercise. As with the panel 1700 of FIG. 17, the panel 2300 can be configured so that it can be used with and without a frame. Sensors 2210 can be made to measure pressure, such as by a strain gauge arrangement, or acceleration by use of an accelerometer.

Figure 23:
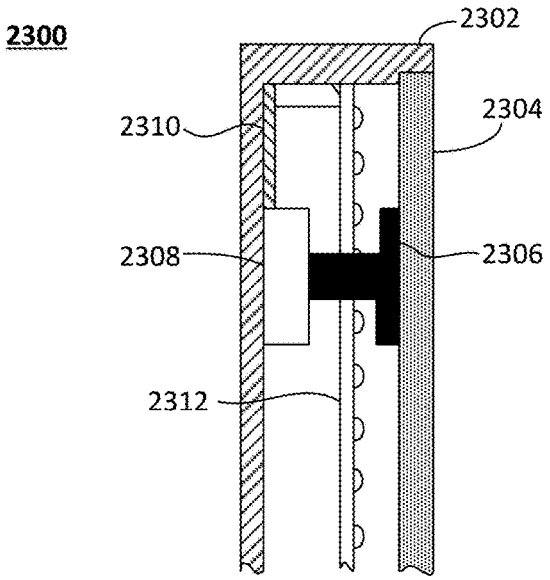
FIG. 23 shows a partial side cut-away view of an illuminating pressure sensing panel in accordance with some embodiments.

FIG. 23 shows a partial side cut-away view 2300 of an illuminating pressure sensing panel in accordance with some embodiments. The panel shown here can be substantially similar to that of FIG. 22. A frame 2302 encloses and holds the other panel components together, including a light-transmissive cover 2304. The cover 2304 can be held at its perimeter by the frame 2302, such as on a shoulder formed by the frame 2302. Furthermore, the cover 2304 is in contact with a post 2306 of a pressure sensor that is coupled to a pressure transducer 2308, where the post 2306 transmits force from the cover 2304 to the pressure transducer 2308. The post 2306 can be the portion of the pressure sensor 2210 shown in FIG. 22. The frame 2302 also houses illumination elements such as a plurality of LED strips such as LED strip 2312. A circuit board 2310 comprises circuitry that receives signals from the pressure transducer 2308 (and the other pressure sensors such as an inertial sensor) to determine a magnitude of force received at each pressure sensor. It can be assumed that the pressure sensors receiving the most force are closest to the point of impact, allowing for the determination of the point of impact on the cover of the panel. The circuit board further comprises circuitry for driving and controlling the LED strip 2312 and the other LED and illumination sources that may be present. The circuit board 2310 can include additional circuitry, such as that illustrated in FIG. 2, including a wireless transceiver and a controller for processing information received from the pressure sensors and determining which LED and/or other illumination sources to turn on, and which to leave off, for a given exercise being conducted with the panel 2300.

Figure 24:
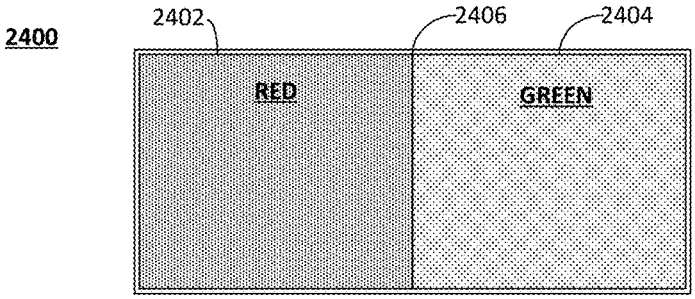
FIG. 24 shows a front elevational view of an illuminating pressure sensing panel configured to illuminate different portions of the panel with different colors, in accordance with some embodiments.

FIG. 24 shows a front elevational view of an illuminating pressure sensing panel 2400 configured to illuminate different portions of the panel with different colors, in accordance with some embodiments. The panel can be constructed similarly to that shown in FIGS. 2, 17, 22, and/or 29. The panel 2400 can have two different sides 2402, 2404 that can display different colors. Each side is capable of illuminating in all colors, however. For example, for a given exercise, side 2402 can be illuminated in red and side 2404 can be illuminated in green. The red color indicates that side 2402 is not to be struck, while side 2404 (in green) is the target. Each side 2402, 2404 can have one or more pressure sensors to detect impact at each respective side. If, in the example, an impact is sensed at side 2402 while illuminated in red, the impact can be scored or logged as a failure or miss. In some embodiments, the two sides can be joined by a hinge 2406 to allow aligning the two sides into different directions. Thus causing a ball that impacts either of the sides to rebound in different directions. So, for example, side 2402, while illuminated in red, can be angled such that if the ball impacts it, the ball will rebound to the side, or away from the user/player, while side 2404 can be angled such that rebounds come back to a position where the user/player is located. Furthermore, during an exercise, the sides can change illumination color as the training exercise progresses.

Figure 25:
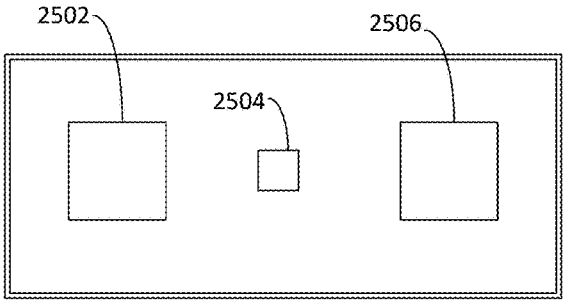
FIG. 25 shows an illuminating pressure sensing panel without a front cover, showing informational displays of the panel assembly, in accordance with some embodiments.
Figure 26:
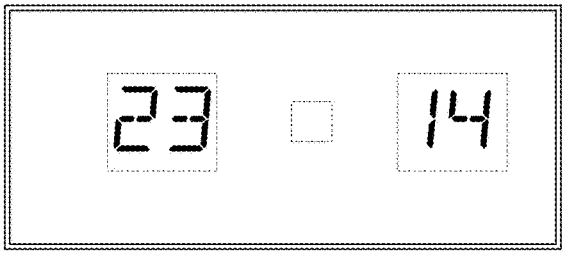
FIG. 26 shows an illuminating pressure sensing panel configured to display information in different portions of the panel, in accordance with some embodiments.

FIG. 25 shows an illuminating pressure sensing panel without a front cover, showing informational displays of the panel assembly, in accordance with some embodiments. While not shown, LED strips or other illumination sources can be present in the panels shown in FIGS. 25-27. Additionally, the panels in FIGS. 25-27 include illumination sources to display information, and include display elements such as display elements 2502, 2504, 2506. The display elements 2502, 2504, 2506 can be matrix or segment displays for displaying characters and symbols, or even video. Accordingly, a cover used with the panels in FIGS. 25-27 include transparent sections located in correspondence with the locations of the display elements 2502, 2504, 2506 so that they can be seen directly by a viewer, and the light emitted by them is not diffused, as it may be at other locations of the cover. FIG. 26 shows an example of a panel. With its cover present, showing two numbers on the left and right halves, respectively. On the left side the display element 2502 is operated to display the number "23" and on the right side the display element 2506 is operated to display the number "14." This can be used in a game, rather than colors, For example, the player must pass the ball to the side of the panel displaying the odd number, and not to the side displaying the even number. It has been found that exercises such as this engage and train the players mind to be more active and train the player to make judgments faster than can be achieved with simpler games. Combining that level of problem solving in an athletic training exercise can lead players to make better strategic judgment, among other types of thinking.

Figure 27:
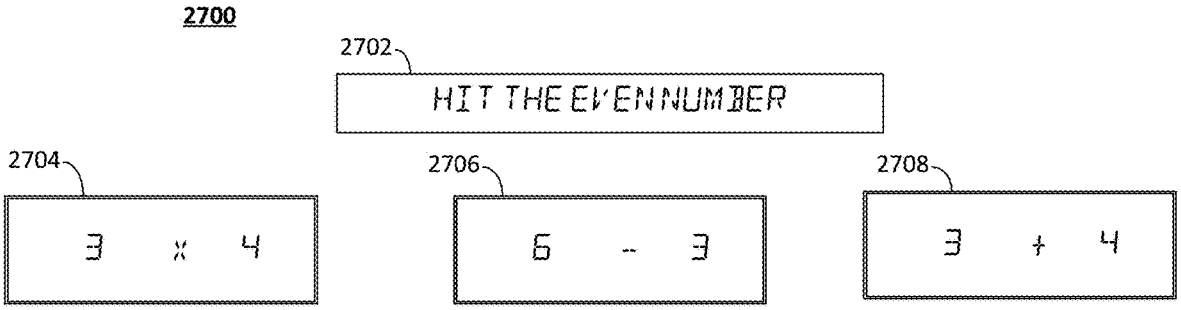
FIG. 27 shows a plurality of illuminating pressure sensing panels arranged for a game configuration, in accordance with some embodiments.

FIG. 27 shows a plurality of illuminating pressure sensing panels arranged for a game configuration, in accordance with some embodiments. The concept of problem solving is extended here, where the player must recognize a criteria given by, for example, a display 2702 (or an audible device), and evaluate the information on each of several panels 2704, 2706, 2708 to determine which panel is displaying the information that best matches the criteria. In the present example, the criteria is given is to find the even number. Each panel displays a simple arithmetic expression that must be evaluated, and one of the results of evaluating the expressions will satisfy the criteria. In this example, panel 2704 displays the expression "3×4," meaning the product of "3" and "4," which is "12," an even number. To satisfy the criteria, then, the player must pass the ball, causing it to impact against the cover of panel 2704 to score a point.

In general, when a game such as that exemplified in FIG. 27 is to be played, the user selects a game from the user interface of the application running on a control device (e.g. smartphone, computer device). The control device can select various expressions or other information to be displayed on the panels, along with some criteria to be issued to the player. At least one expression selected will satisfy the criteria. The control device then assigns each expression to one of the panels, and transmits the selected expression to the to panel. The panel then, at the commencement of the game, displays the expression and waits to detect an impact. Upon detecting an impact, the panel can transmit the occurrence of the impact, and the location of the impact if needed, to the control device for scoring. Those skilled in the art will appreciate that many different games can be designed that require the player to evaluate information on each panel and select the panel that best matches a given criteria. In some cases the criteria can be inherent. For example, a series of words representing colors can be displayed, one word on each half of a panel, or one word on a panel, where the words are each illuminated in a given color, but only one word is illuminated in the color matching the word. For example, panel 2704 cane display the word "green" illuminated in red, panel 2706 can display the word "red" illuminated in green, and panel 2708 can display the word "green" illuminated in green; in such an example if the player impacts panel 2708 before the other panels, the player will have selected the correct panel.

The examples of FIGS. 25-27 show how users/players engaged in athletic training can also be cognitively trained to increase neural efficiency in conjunction with athletic/fitness training. These examples go beyond a simple "one step" pattern recognition thought process (e.g. picking the right color) and require higher level thinking by the user. The use of metronomes in conjunction with athletic training are well known to improve neural efficiency (e.g. https://www-.teamsnap.com/community/sports-science/sports-science-for-high-performance-athletes/improving-athletic-skill-is-all-about-timing). The mental problem solving provide by some embodiments herein are believed to also augment cognitive ability as a benefit to athletic performance, such as decision making during a game, as well as outside of athletic endeavors.

Figure 28:
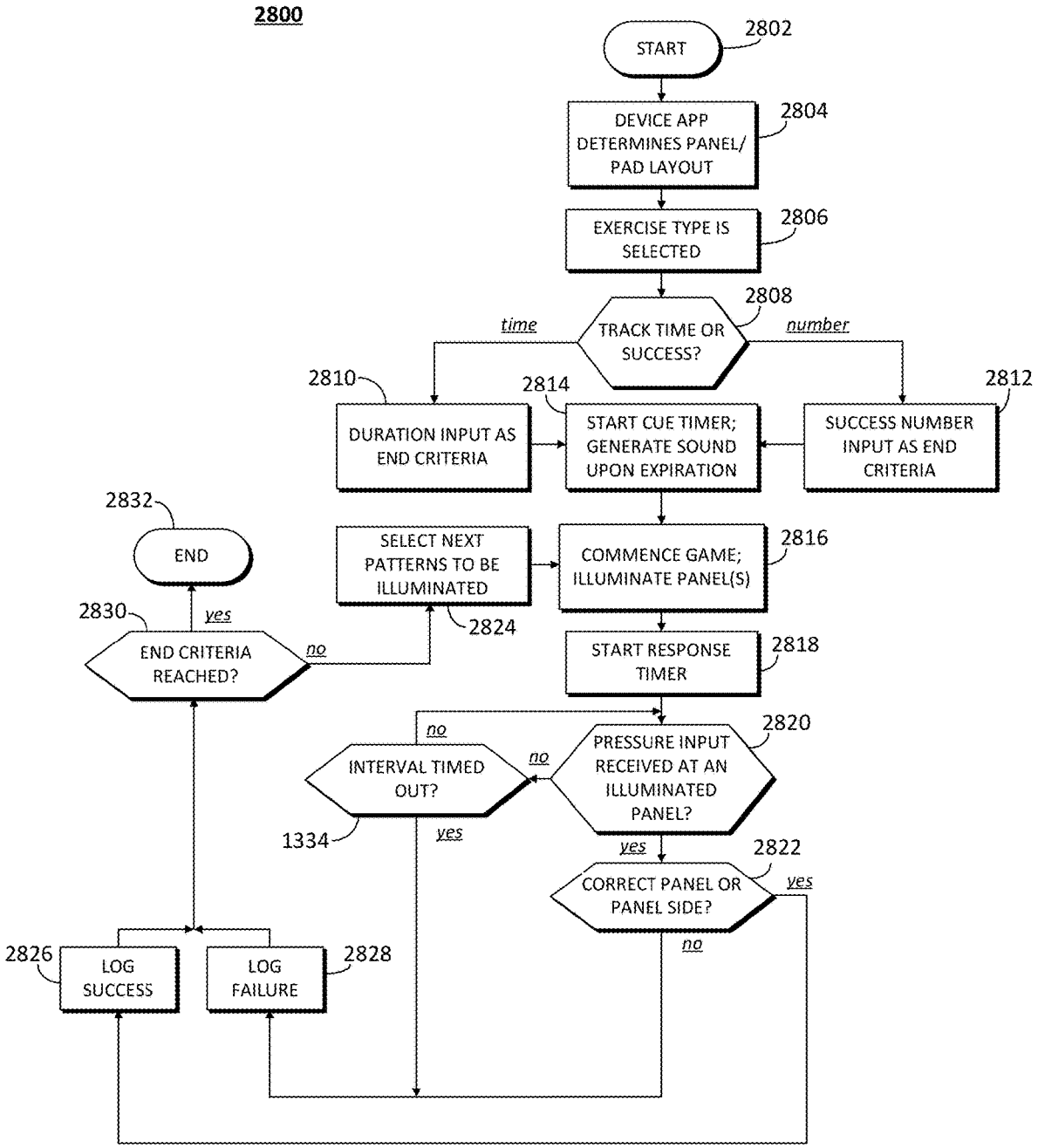
FIG. 28 shows a flow chart diagram of a method of operating one or more illuminating pressure sensing panels for a game, in accordance with some embodiments.

FIG. 28 shows a flow chart diagram of a method 2800 of operating one or more illuminating pressure sensing panels for a game, in accordance with some embodiments. At the start 2802 the system is powered up, meaning both the control device (e.g. control device 114) and the panel or panels are powered and ready for use. A first step 2804 can include the control device determining the panel layout, meaning their physical locations with respect to each other. Alternatively the user can indicate the locations of the panels, or the location information can be skipped as irrelevant for the exercise. In some embodiments the control device can, for example, transmit a wireless beacon, causing the panel or panels to respond, giving some indication of their relative location with respect to each other. In some embodiments a grid address convention can be used where a wall, row, and column parameter can be indicated in a panel's address information. Alternatively, the panel or panels can simply respond as being present, and the user of the control device can input information for each discovered panel regarding its relative location.

In step 2806 the user of the control device can select an exercise or regimen to be used. Various exercises can be described in models stored by the control device, or in a cloud server accessible by the control device. Each model can describe, for example, sequences for lighting or changing the lighting of panels, information to be displayed on panels, criteria to be given to the user for a given game or exercise, and so on. In step 2808 the user can provide a selection of the regimen end criteria, such as a maximum duration of time, or a number of successes. Accordingly, if time is selected, then the method proceeds to step 2810 where the input time value is used as an end of regimen criteria. If in step 2808 a number of successes is indicated as an end of regimen criteria, the method proceeds to step 2812 where the number of successes indicted is input as the end of regimen criteria. In step 2814 the regimen is commenced by a device (e.g. the control device, a timer, a display, etc.) where a ready sound can be played, or some other "get ready" indication can occur (e.g. blinking a panel's illumination on and off). In step 2816 the regimen is commenced by illuminating one or more panels in one or more groups, or displaying information on panels, depending on the selected regimen. During commencement of the exercise the control device determines which panels are to be illuminated in sequenced exercises, or what information is to be displayed on the panels in succession as an exercise commences and the player or user succeeds in hitting the correct panels, and sends a signal via the wireless local area network protocol to the selected panel or panels to turn on their illumination, display information (including the information to be displayed), or the color of the illumination in a multicolor regimen, including which portion of a panel is to be illuminated with a particular color where panels are illuminated in multiple colors. Using the wireless local area network protocol, the panel or panels can acknowledge the command and indicate compliance/success in turning on their illumination. In step 2818 the control device, or each panel, or both, can commence a response timer to measure the time from being illuminated to receiving an impact in timed exercises. If the control device operates the response timer than it depends on receiving an indication of an impact, via the wireless local area network protocol, from an impacted panel in order to stop or otherwise note the response timer value.

In step 2820 the method 1300 determines whether a pressure input, i.e. an impact, is received at one of the panels. A panel that is not part of the exercise at the moment of impact will ignore impacts. Upon being struck or otherwise receiving an impact, an illuminated panel transmits an impact message to the control device via the wireless local area network protocol, which can include which portion of the panel was impacted based on impact force differential as detected by the multiple pressure sensors in each panel. The method 2800 loops between steps 2820 and 2834 as long as no impact is detected. Step 2834 determines whether an interval timer has expired, meaning that the maximum time for the player to hit an illuminated panel, or a panel satisfying the game criteria has expired. If no maximum interval time is selected then step 2834 can be skipped, and step 2820 simply keeps repeating. Upon an impact being detected, the method 2800 proceeds to step 2822 where it is determined whether the correct panel was impacted for games where information is presented on panels and the player must find the panel that satisfies a given criteria, or whether the correct portion of a panel was impacted in games where different portions are illuminated differently with one color indicating the correct portion of the panel to be struck.

If the impact indication received from the panels indicates an incorrect panel or incorrect panel portion was impacted, then in step 2828 a failure can be logged. If the impact is on a correct panel or panel portion, then the method proceeds to step 2826 where a success is logged. After either step 2826 or 2828 is performed, the method 2800 can proceed to step 2830 where the method 2800 proceeds to step 2830 to determine whether the end criteria has been met (e.g. the number of success, the maximum duration, the number of puzzles presented, and so on). If the end criteria has been reached then the method 2800 ends 2832. If the end criteria has not been met in step 2830, then the next sequence step commences in step 2824, where a different panel illumination pattern can be presented by the panel(s), or different information and criteria can be presented on the panel(s), and the exercise continues in step 2816 for another iteration.

Figure 29:
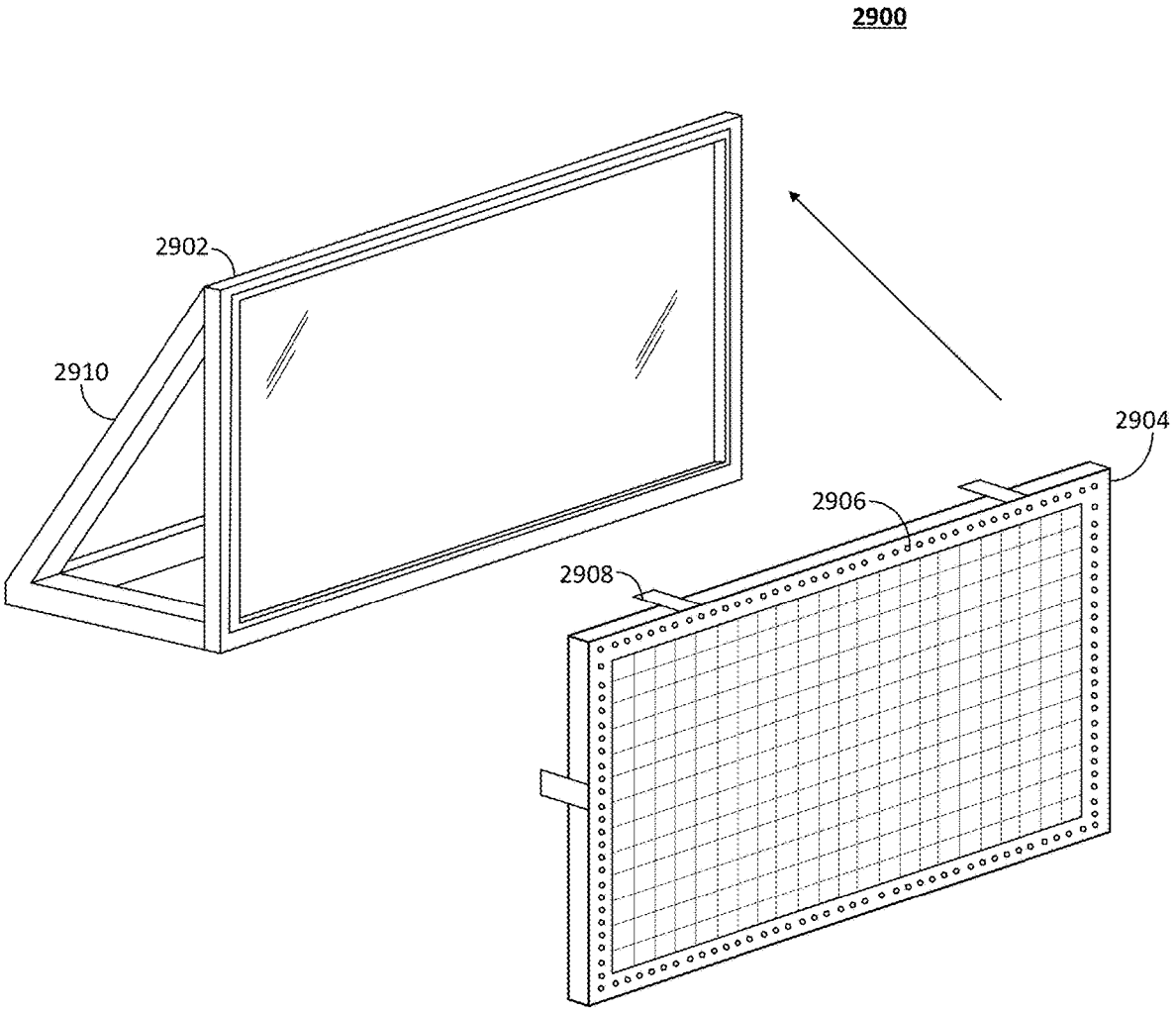
FIG. 29 shows a rebound control overlay for dampening rebound of a ball from a panel, in accordance with some embodiments.

It will be appreciated that the embodiments of FIGS. 22-28 can be adapted for use with any number of panels. A single panel can have different portions illuminated differently, for example, with one type of illumination (e.g. color) being a target. In games where the player must select the panel displaying information that satisfies a given criteria, one or more panels can be used, or a large number of panels arranged in a matrix (e.g. as in FIGS. 3-12) can be used where one or more panels can display information for evaluation by the player. Furthermore, FIG. 29 shows a rebound control overlay arrangement 2900 for dampening rebound of a ball from a panel 2902, in accordance with some embodiments. The panel 2902 is an illuminating, pressure sensing panel such as that shown, for example, in FIGS. 17 & 22. A rebound overlay 2904 is adapted to fit over the front of the panel 2902. The rebound overlay includes material that tends to absorb energy from an object, such as a ball, that impacts the material, and causes a different rebound response than if the object had struck the bare front surface of the panel 2902. In some embodiments the material can be taut cordage that is weaved, such as is used on, for example, tennis racquets. In some embodiments the material can be elastic cordage to dampen the rebound response, and slow the ball or object down as it rebounds by absorbing some of the kinetic energy of the ball. In some embodiments the material can be a substantially transparent gel-like material, such as, for example, a silicone sheet. The use of the material simulates the effect of, for example, passing a soccer ball to another player. The ball can still impact the front surface of the panel 2902 to register an impact, but the rebound of the ball can be substantially dampened or diminished for a training regime that doesn't return the ball with a typical full rebound. It is further contemplated that the rebound overlay 2904 can be an active overlay that detects the impact of the ball an impart additional energy to augment the rebound response, similar to another player kicking the ball back. In an active rebound overlay the overlay 2904 can be mounted on pistons that can be actuated by the panel 2902 upon sensing an impact to drive the overly 2904 away from the front surface of the panel 2902 for a short distance, and over a short period of time.

In some embodiments a frame such as that used by the rebound overlay 2904 (with or without the rebound material) can include lighting elements 2906 around the periphery of the frame. The lighting elements 2906 can be, for example, a series of LEDs for producing various colors of light. The lighting elements 2906 can be operated by the panel 2902 through one or more connectors 2908 that electrically connect to the lighting elements, and which can also facilitate securely attaching the overlay 2904 to the panel 2902. During operation the lighting elements 2906 can be operated in conjunction with the lighting elements of the panel 2902, or instead of using the lighting elements in the panel 2902. Thus, lighting elements 2906 can be lit in different colors to signify the panel 2902 is a target or not a target at any given time. Additionally, the lighting elements 2906 can augment lighting on the panel 2902 by, for example, flashing upon a successful impact, or acting as a "count down" feature by reducing the number of LEDs lit over time to indicate how much time is left to contact the panel 2902, and so on.

Further, in some embodiments, a panel 2902 can be mounted on a stand 2910. The stand 2910 can be used to support a panel 2902, and generally keep it from moving upon the panel being impacted. In some embodiments vertical members at each side of the stand 2910 can be attached to the back of the panel 2902 by hinges to allow the side vertical members to be folded or swung flat against the back of the panel 2902. The stand 2910 allows easy and quick setup and mobility of the panel 2902, and allows users to set up several panels for a training session or game in any arrangement desired by the users.

Figure 30:
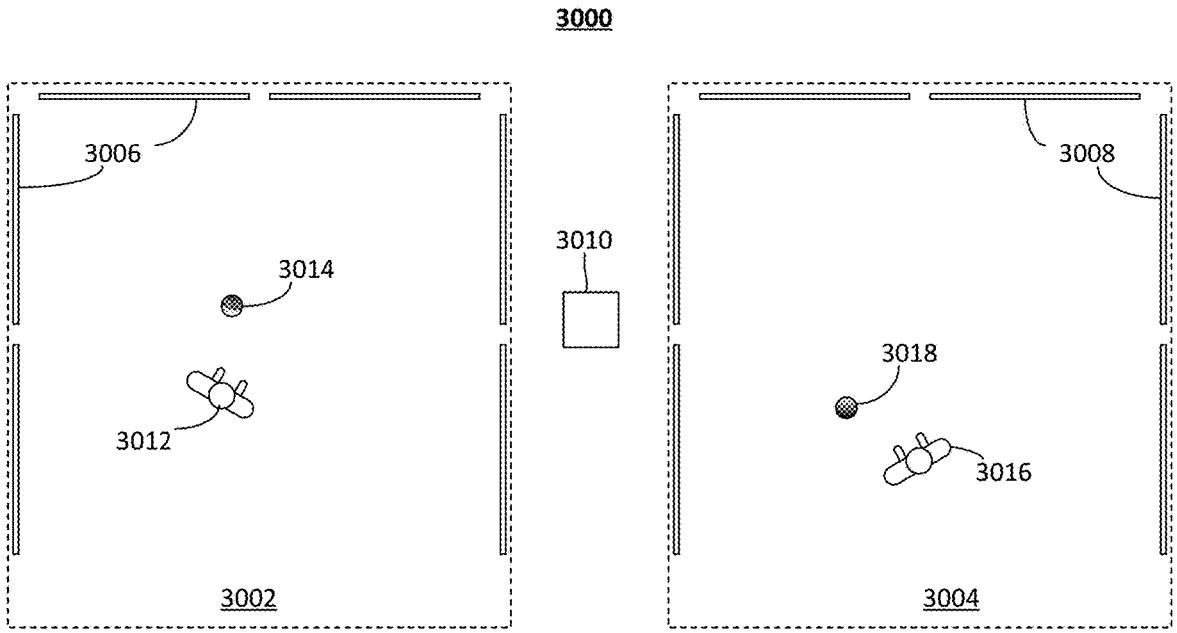
FIG. 30 shows an overhead view of several game areas for competition for a multi-player competition using a configurable panel-based athletic system in accordance with some embodiments.

FIG. 30 shows an overhead view 3000 of several game areas for competition for a multi-player competition using a configurable panel-based athletic system in accordance with some embodiments. In addition to solo training, or multi-player training in a single training region, multiple regions can be set up where the same training or game criteria and regimen are used to allow different people to compete against each other using the same game sequence. in the present example there is shown two areas 3002, 3004. Each area 3002, 3004 includes several panels such as panels 3006, 3008, respectively. The panels are illuminating pressure sensing panels such as that shown in FIGS. 2, 17, 22. A control device 3010 is in communication with each of the panels in both areas 3002, 3004. Each area 3002, 3004 is used by a respective player 3012, 3016 who each use a ball 3014, 3018, respectively. The control device 3010 can be used to select a regimen or game that specifies a series of conditions where the panels in each area 3002, 3004 are illuminated or display information, requiring the players 3012, 3016 to decide which panels are to be hit with their ball 3014, 3018 in a given order. The control device 3010 receives information from the panels indicating whether they sensed an impact, and the control device keeps track of each player's progress until an end condition is met. A score or time for each player to complete the regimen or game can be indicated by the control device, either on a display of the control device, 3010, or on another device that is in communication with the control device 3010.

Figure 31:
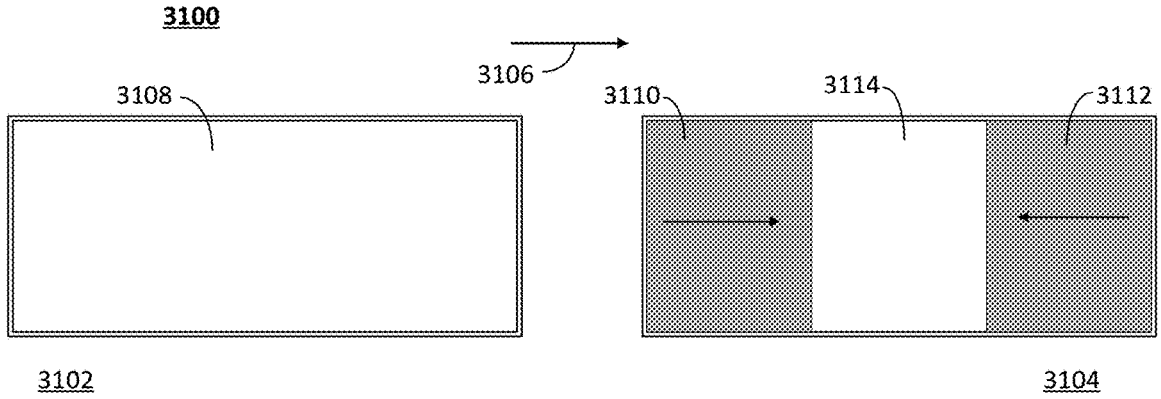
FIG. 31 shows a time diagram where a target region of a panel changes over time.

FIG. 31 shows a time diagram 3100 where a target region of a panel changes over time. The same panel is shown at a first time 3102 and at a second time 3104, and arrow 3106 indicates the progression of time. The panel is used in a training regimen or game, and is controlled by a control device (not shown). The panel is a pressure sensing panel that is configured to sense pressure or contact at different locations on the front surface (the surface in view in FIG. 31) and can determine where an impact or contact occurs on the front surface of the panel. The example of FIG. 31 indicates that an illuminated target region of the panel can be changed over time to increase the difficulty (or ease) of scoring a successful contact on the panel during a regimen or game. For example, at the first time 3012, the illuminated region 3108 can be the entire front region of the panel, and the illuminated region is decreased over time. Thus, at the second time 3104, the illuminated region 3114 is then smaller, with non-illuminated regions 3110, 3112. At time 3102 at hit anywhere on the front surface will be considered a success, but at time 3104 hitting the panel in regions 3110, 3112 are not scored as successes, and only a hit or impact in region 3114 will be considered a success. Accordingly, the panel comprises several pressure sensors to detect pressure at different locations on the front surface. The front surface can be comprised of articulating segments, rather than completely rigid, to allow easier identification of the location of impacts.

Figure 32:
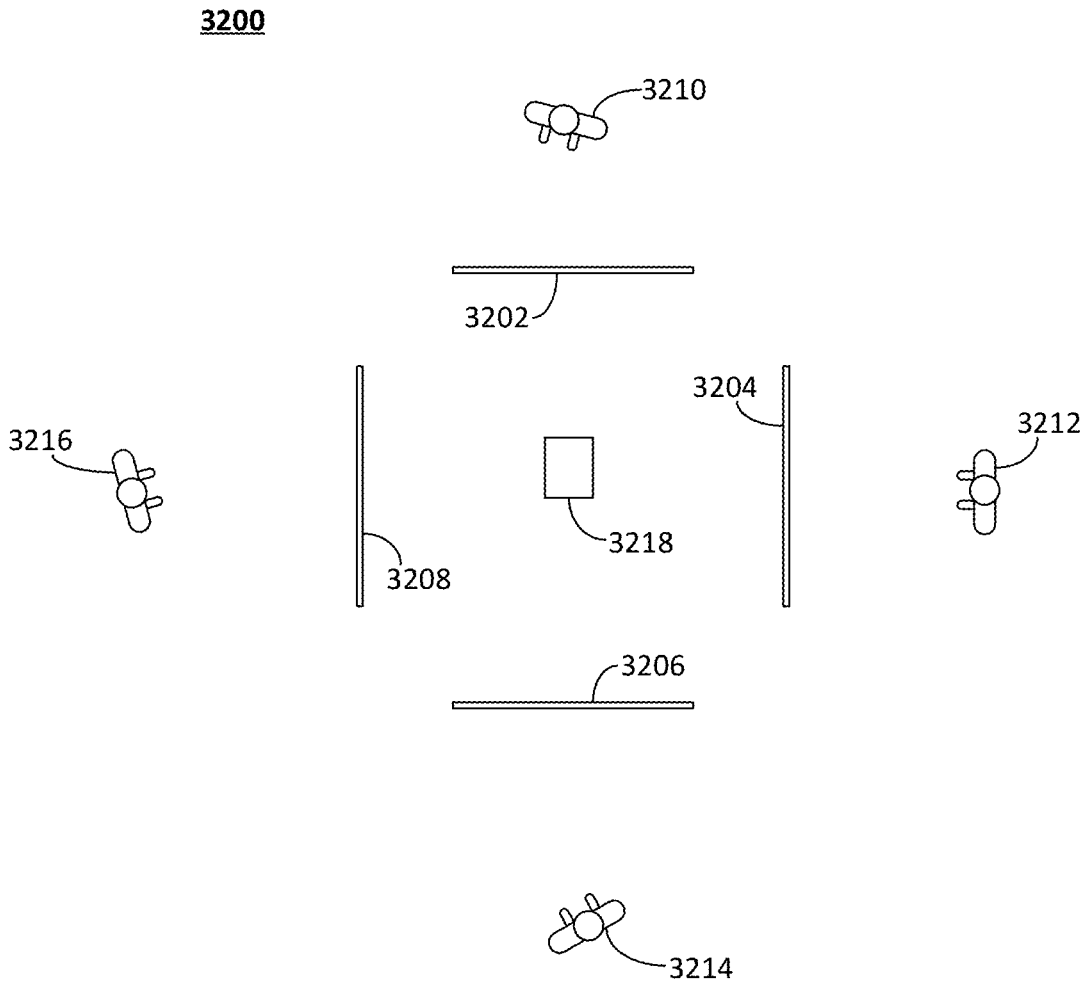
FIG. 32 shows an arrangement of panels to encourage group communication during athletic training or games, in accordance with some embodiments.

FIG. 32 shows an arrangement 3200 of panels 3202, 3204, 3206, 3208 to encourage group communication during athletic training or games, in accordance with some embodiments. The panels 3202-3208 are arranged such that they face outward from a central point between or among the panels 3202-3208, and can be operated in accordance with, for example, the flow chart of FIG. 28. Different ones of the panels 3202-3208 can be illuminated at different times; when a panel is illuminated, it is a target, and impacting it, e.g. with a game ball, constitutes a score or otherwise success. The panels can be controlled wirelessly by, for example, a device 3218, such as a cellular phone device ("smartphone"), or some other computing device running an application program to operate the panels 3202-3208.

A person or player 3210, 3212, 3214, 3216 can be stationed in front of each one of the respective panels 3202-3208. In this configuration only the player 3210-3216 can see whether their respective panel 3202-3208 is illuminated as the present target. When a player 3210-3216 sees their respective panel 3202-3208 light up as the target for a present time interval, that player 3210-3216 must call out to whichever other player presently has the game ball so that the game ball can be passed to the player so that the player can then strike their respective panel with the game ball. Thus, the illustrated configuration requires and trains players to communicate and work cooperatively to score. The configuration 3200 can be duplicated to allow team competition, where a score for each team can be measured as a criteria.

Figure 33:
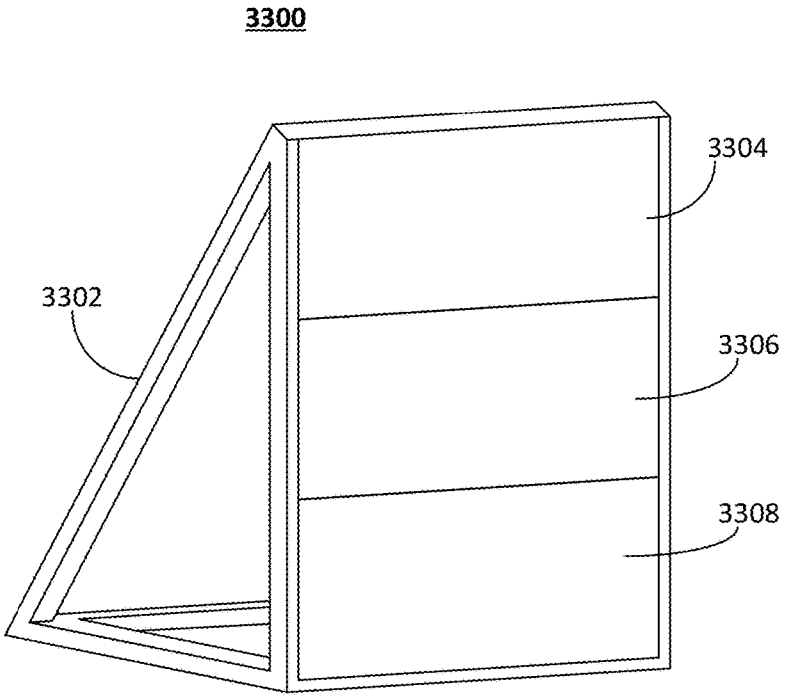
FIG. 33 shows a stand in which panels can be stacked vertically.

FIG. 33 shows a stacking system 3300 utilizing a stand 3302 in which panels can be stacked vertically. In the present example three panels 3304, 3306, and 3308 are shown stacked vertically and held in place by stand 3302. The panels can be slid into guides on either side of the front of the stand 3302, or otherwise held in position using conventional means. The panels 3304-3308 can be designed and operated substantially as that shown and described in reference to and of the previous figures. The stand 3302 provides support to hold the panels 3304-3308 in place during operation, as well as support to maintain them in an upright position during use (i.e. against frontal impacts that would tend to cause them to fall over). The panels 3304-3308 can each be separately controlled to illuminate and/or display information independently as target or non-target panels for a current training interval in a training regime or game. For example, panel 3304 can be illuminated in a target color (e.g. green) while panels 3306, 3308 can be illuminated in a non-target color (e.g. red), requiring a player/trainee to loft a play ball upwards to impact against panel 3304 for a score. The stand 3302 can be constructed so that panel 3306 can be omitted while retaining panel 3304 in the position shown, leaving an empty space between panels 3304 and 3308. By arranging the panels 3304-3308 vertically a person can get substantially similar training benefit as with the larger arraignments shown and described in earlier figures, but on a smaller equipment scale.

Figure 34:
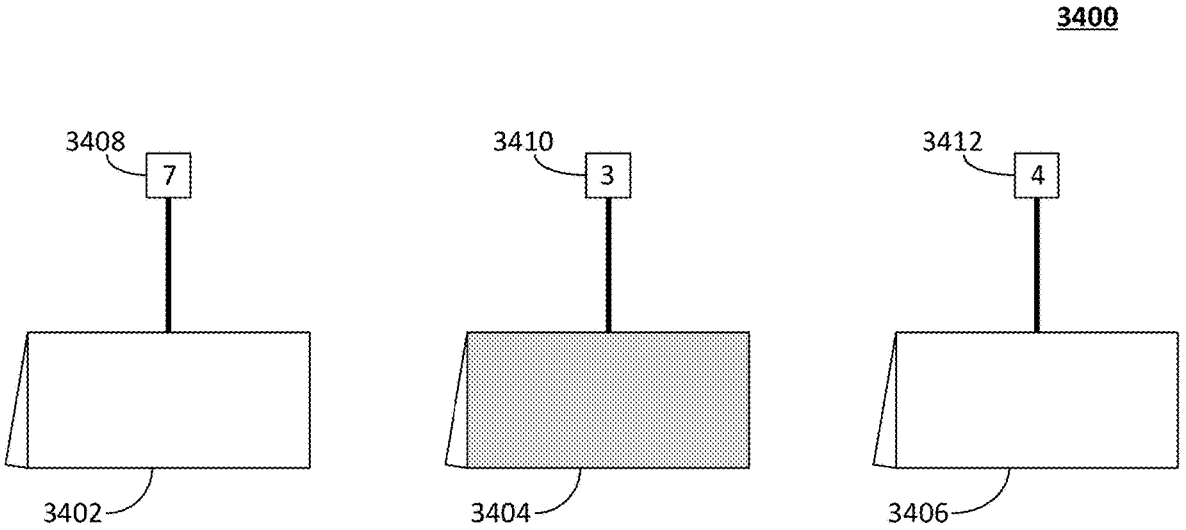
FIG. 34 shows an arrangement of panels having cueing displays located vertically over each panel on which information is presented.

FIG. 34 shows an arrangement 3400 of panels having cueing displays located vertically over each panel on which information is presented. In the example shown three panels 3402, 3404, and 3406 are shown, arranged horizontally. The panels 3402-3406 can be designed and operated substantially as that shown and described in reference to and of the previous figures. Each panels 3402-3406 has a respective cueing display 3408, 3410, 3412 mounted on a mast and located vertically above the panels 3402-3406 at a standoff distance. The standoff distance is meant to separate the cueing display from its associated panel enough so that the player/trainee must take their visual focus off the panel to look at the cueing display. The standoff distance can be two feet or more. In some embodiments a panel can be located approximately at ground level and its associated cueing display can be located approximately at a distance above the panel that would correspond to the height of the head of a standing person. In some embodiments the cueing display can be located to the side (horizontally) of its associated panel, or at other angles relative to the panel.

The cueing displays can display information related to a training regimen, used to identify which of the panels 3402-3406 is the current target. For example, panels 3402 and 3406 can both be illuminated in a color associated with a valid target, which panel 3404 is not illuminated, or illuminated with a color indicating it is not a potential target in the present training interval. Which means either panel 3402 or panel 3406 is the correct target. The criteria can be, for example, selecting the panel associated with the cueing display that is displaying an even number, meaning panel 3406 would be the correct target since cueing display 3412 is displaying a "4" while cueing display 3408 is displaying a "7." Various games and exercises such as those described in relation to FIGS. 25-27 can be implemented using the cueing displays. By using the cueing displays 3408-3412, the player/trainee must look up at the cueing displays 3408-3412 to select the proper target panel 3402-3406. This is an important habit to train in games like soccer/futbol because a player must ensure that another player is looking before the player passes the ball. The masts on which the cueing displays 3408-3412 are mounted can be resilient so as to absorb errant impacts if a player/trainee misses the panel while attempting to impact a panel 3402-3406 with a ball. This can be a critical skill that is difficult to train, otherwise.

The cueing displays 3408-3412 can be operably connected to either their respective panel 3402-3406, or separately to a control system that the panels 3402-3406 are also connected. The connections can be wired or wireless. In some embodiments the cueing displays 3402-3406 can be made of an LED matrix, and in other embodiments the cueing displays 3402-3406 can be tablet-type computing devices that execute an application under control of a control system to which the devices are connected. In some embodiments the cueing display can be another panel, or a portion of another panel. For example, in FIG. 33, panel 3304 can act as a cueing display for panel 3308. Furthermore, the cueing displays 3402-3406 can be touch or impact sensitive to detect being touched by a player/trainee as a requirement of a training regimen.

The embodiments disclosed herein provide the benefit of a structured athletic exercise system that allows users to develop skills in a dynamic manner simulating team play, but without requiring multiple people to create a team play environment. Furthermore, the disclosed system and components allows users to develop exercise regimens to drill particular skills in a dynamic manner in a way that cannot be achieved with a static apparatus. Still further, the disclosed system and components actively force the development of cognition skills in conjunction with physical athletic skills by presenting puzzles or games that require the player to evaluate during play to solve by selecting the panel displaying information that satisfies the given criteria. The system is customizable in size and configuration, and the exercise regimens can be adapted to the number of panels present, from one panel to a small number of panels at ground level, to a system where several walls are covered in a matrix or grid of panels. The system also allows users to save results in a network connected storage system that can be accessed by others, such as coaches, trainers, or other supervisors (or friends or other social contacts). The disclosed system and components allow users to train specific exercises, as well as to recreate specific plays from games that have occurred. The panels can be arranged to represent the locations of other players during a give play in a game, and the player/trainee can practice a specific set of actions to copy or duplicate a remarkable play that occurred in an actual game. An application program used in conjunction with the system on a user device can present information about setting up panels in a specific configuration to reproduce the desired play or exercise. In some embodiments the application program can access a cloud server where a service uploads play configurations based on recently played professional games, providing user/trainees an ever-increasing variety of exercises to practice and simulate plays by their favorite professional athletes.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description as part of the original disclosure, and remain so even if cancelled from the claims during prosecution of the application, with each claim standing on its own as a separately claimed subject matter. Furthermore, subject matter not shown should not be assumed to be necessarily present, and that in some instances it may become necessary to define the claims by use of negative limitations, which are supported herein by merely not showing the subject matter disclaimed in such negative limitations.

I claim:

1. A user configurable athletic training system involving multiple panels that are independently positionable as sensor-enabled targets for a soccer ball, comprising:

two or more panels, each being a stand-alone, portable device having its own panel address, wherein each of the two or more panels are independently positioned relative to each other in a geographic region, wherein a control device records relative locations of the two or more panels in the geographic region as a layout map that ties physical location to each respective panel address of the two or more panels, each panel of the two or more panels, configured to provide visually distinct output in accordance with selected visual patterns in at least two regions of a front surface of the respective panel, and to detect an impact of a soccer ball at the front surface of the panel including a location of a point of the impact on the front surface relative to the at least two regions, each panel further including a wireless transceiver and a power source; and the control device that is operably coupled to the two or more panels, and which is configured to responsive to a user input, communicate training information to any number of panels from 1 to N, where N is an integer greater than 1, wherein different training scenarios are available through the control device depending on the number of panels from 1 to N available, wherein the different training scenarios includes one for communicating coordinated training information to the two or more panels that indicates the selected visual patterns to be provided at the at least two regions of the front surface of the respective panel, wherein the visual patterns relate to a selected training criteria, and wherein the control device is further configured to receive impact information from the respective panels, wherein impact information determines whether impact resulting from a soccer ball striking the respective panel achieved compliance with the selected training criteria, wherein the training information is conveyed between the control device and the two or more panels in accordance with a training scenario dependent upon the layout map.

2. The user configurable athletic training system of claim 1, wherein the at least one panel further comprises a plurality of illumination scores configured to produce at least two different colors, and wherein a visually distinctive output comprise outputting light form the at least two illumination sources such that a first region of the at least two regions is a first color, and the second region of the at least two regions is a second color.

3. The user configurable athletic training apparatus of claim 2, wherein the selected training criteria comprise receiving an impact at the first region and not at the second region.

4. The user configurable athletic training apparatus of claim 1, wherein the at least one panel is a plurality of panels;

each panel of the plurality of panels includes at least one display component for displaying information, wherein each of the plurality of panels receives respective unique information to be displayed on the at least one display component during a training exercise from the control device, wherein the respective unique information provided to at least one of the plurality of panels satisfies the selected training criteria; and wherein upon receiving impact information from one of the plurality of panels the control device determines whether the impact information came from the at least one of the plurality of panels having unique information that satisfies the selected training criteria.

5. The user configurable athletic training apparatus of claim 4, wherein the respective unique information provided to each of the plurality of panels comprises an expression that requires solving by the user to determine whether it satisfies the selected criteria.

6. The user configurable athletic training apparatus of claim 5, wherein the respective unique information comprises an arithmetic expression.

7. The user configurable athletic training apparatus of claim 1, further comprising: an inertial sensor for determining the inertia of the soccer ball striking the front surface.

8. The user configurable athletic training apparatus of claim 1, further comprising an attachable/detachable rebound overlay disposed over the front surface of the at least one panel, wherein the rebound overlay provides a rebound response that is different from the front surface of the panel.

9. The user configurable athletic training apparatus of claim 1, wherein the at least two regions are separated by a hinge that allow each region to be separately oriented.

10. The user configurable athletic training apparatus of claim 1, wherein an illuminated area on the at least one panel changes over time, and wherein the at least one panel determines whether a sensed impact is with an illuminated region or not at the time of impact.

11. The user configurable athletic training apparatus of claim 1, further comprising at least one cueing display associated with the at least one panel, where when there is more than one panel, each panel has its own associated cueing display, wherein the at least one cuing display is mounted at a standoff distance from the at least one panel.

12. An athletic training apparatus involving 2 to N panels that are independently positional as sensor-enabled targets for a soccer ball, wherein N is an integer greater than or equal to 2, said athletic training apparatus comprising:

a plurality of the 2 to N panels, each being a stand-alone, portable device having its own panel address, wherein each of the two or more panels are independently positioned relative to each other in a geographic region, each panel comprising:

a display component at a front surface of the panel configured to visually display information;

at least one pressure sensor to detect an impact of a soccer ball at the front surface of the panel;

a wireless network transceiver;

wherein a control device records relative locations of the plurality of panels in the geographic region as a layout map that ties physical location to the respective panel address of the plurality of panels, wherein each panel receives training information from a control device via the wireless network transceiver, the training information received by each panel being unique among the plurality of panels, each panel being configured to display its respective training information at its respective display component, detect an impact at its front surface via the pressure sensor, and to transmit impact information to the control device of an impact via the pressure sensor, wherein the control device manages different training scenarios involving any number of the panels from 2 to N, wherein the control device coordinates training information between panels while considering the physical location of the coordinated panels per the respective layout map.

13. The apparatus of claim 12, wherein the training information comprises a mathematical expression.

14. The apparatus of claim 12, wherein the training information includes text information and an indication of a color in which the text is to be displayed, wherein the text is displayed on the display component in the color indicated.

15. The apparatus of claim 12, wherein each of the plurality of panels further comprises an illumination source that is selectively enabled based on the training information received from the control device.

16. The apparatus of claim 12, further comprising an attachable/detachable rebound overlay disposed over the front surface of at least one panel of the plurality of panels, wherein the rebound overlay provides a rebound response that is different than the front surface of the panel.

17. The apparatus of claim 12, wherein the plurality of panels includes at least one panel having a radio frequency identifier (RFID) reader.

18. The apparatus of claim 12, wherein the plurality of panels are organized into at least two sets, with each set including at least one panel, and wherein the control device communicates the training information to each of the sets at the same initial time, and determines either a score or a time for completion of the training criteria.

19. A method of operating a user-configurable athletic training system involving 2 to N panels that are independently positional as sensor-enabled targets for a soccer ball, wherein N is an integer greater than or equal to 2, comprising:

providing an arrangement of 2 to N panels, wherein N is an integer greater than or equal to 2, wherein each panel is a stand-alone, portable device having its own panel address, wherein each of the plurality of panels are independently positioned relative to the others in a geographic region, each panel including a controllable illumination source that controllably illuminates a front surface of the respective panel at least two different regions of the front surface, at least two pressure sensors for sensing pressure input at the front surface of the respective panel and providing a pressure signal, and a communication circuit;

recording relative locations of the panels in the geographic region as a layout map that ties physical location to the respective panel address of the panels;

receiving, at a control device that is in communication with the panels, an input selecting a training regimen, wherein the training regimen specifies information for illuminating the at least two different regions of the front surface of the respective panels during each of one or more intervals of the training regimen, wherein the training regimen is dependent upon the layout map;

the control device commanding the respective panels to illuminate the front surface at the two regions according to the regimen;

the respective panels, upon being commanded to illuminate, turning on its illumination source thereby causing the two different regions to be illuminated in a visually distinct manner;

detecting, via the at least two pressure sensors, an impact of a soccer ball at the front surface of the respective panels, including a location of a point of impact relative to the at least different regions;

transmitting to the control device an indication of the impact and the location of the impact;

correlating the location to a geographic location consistent with the layout map; and repeating the commanding, turning on, detecting, and transmitting steps a plurality of times during the training regime.

20. The method of claim 19, wherein the illumination source comprises a plurality of illumination sources configured to produce at least two different colors, and wherein turning on the illumination source comprises illuminating from the at least two illumination sources such that a first region of the at least two regions is illuminated in a first color, and a second region of the at least two regions is illuminated in a second color.

21. The method of claim 20, further comprising:

determining whether the impact location satisfies a selected training criteria of the regimen.

22. The method of claim 21, wherein determining whether the impact location corresponds to the first region or the second region of the at least one panel.

23. The method of claim 19, wherein providing the at least two pressure sensors comprises providing at least two inertial sensors, and detecting the impact comprising detecting the impact via the inertial sensors.

* * * * *